US006169470B1

(12) United States Patent
Ibata et al.

(10) Patent No.: US 6,169,470 B1
(45) Date of Patent: Jan. 2, 2001

(54) COILED COMPONENT AND ITS PRODUCTION METHOD

(75) Inventors: Akihiko Ibata, Takaishi; Shinji Harada, Katano; Tadashi Kawamata, Settsu, all of (JP)

(73) Assignee: Matsushita Electric Industrial Co., Ltd., Kadoma (JP)

( * ) Notice: Under 35 U.S.C. 154(b), the term of this patent shall be extended for 0 days.

(21) Appl. No.: 09/068,928

(22) PCT Filed: Nov. 27, 1996

(86) PCT No.: PCT/JP96/03462

§ 371 Date: Oct. 30, 1998

§ 102(e) Date: Oct. 30, 1998

(87) PCT Pub. No.: WO97/20327

PCT Pub. Date: Jun. 5, 1997

(30) Foreign Application Priority Data

| | | |
|---|---|---|
| Nov. 27, 1995 | (JP) | 7-307079 |
| Dec. 14, 1995 | (JP) | 7-325435 |
| Mar. 22, 1996 | (JP) | 8-65949 |
| Mar. 22, 1996 | (JP) | 8-65952 |

(51) Int. Cl.[7] ..... H01F 27/02

(52) U.S. Cl. ..... 336/83; 336/200; 336/231; 336/225

(58) Field of Search ..... 336/83, 225, 231, 336/223, 200, 208

(56) References Cited

U.S. PATENT DOCUMENTS

| | | | | |
|---|---|---|---|---|
| 770,432 | * | 9/1904 | Kinraide | 336/231 |
| 3,971,126 | | 7/1976 | Buhrer | 29/604 |
| 5,225,969 | * | 7/1993 | Takaya et al. | 361/414 |
| 5,363,080 | * | 11/1994 | Breen | 336/192 |
| 5,761,791 | * | 6/1998 | Bando | 29/609 |

FOREIGN PATENT DOCUMENTS

| | | | |
|---|---|---|---|
| 0 157 927 | | 10/1985 | (EP) . |
| 0 435 160 | | 7/1991 | (EP) . |
| 828291 | * | 1/1956 | (GB) . |
| 828291 | | 2/1960 | (GB) . |
| 6-120024 | | 4/1994 | (JP) . |

* cited by examiner

*Primary Examiner*—Michael L. Gellner
*Assistant Examiner*—Tuyen T. Nguyen
(74) *Attorney, Agent, or Firm*—Wenderoth, Lind & Ponack, L.L.P.

(57) ABSTRACT

A coiled component (K1) having an insulating member (3) and a conductive member (5). The conductive member is provided in the insulating member (3) and has a plurality of turns which are gradually different, in diameter, from each other from one end towards the other end of the conductive member (5) such that at least the turns of the conductive member (5) are disposed in different planes, respectively. Also, a magnetic layer (8, 9) is provided on at least one of upper and lower faces of the insulating member (3).

17 Claims, 17 Drawing Sheets

COILED COMPONENT AND ITS PRODUCTION METHOD

TECHNICAL FIELD

The present invention relates to a coiled component for use in various electronic appliances and communication appliances.

BACKGROUND ART

Coiled components are frequently used as coils and transformers for various electronic appliances and communication appliances and demand for more compact and thinner coiled components is increasing recently. Furthermore, in response to higher frequency and digitization of circuits, the coiled components play a vital role more and more so as to reduce noises.

Conventionally, a planar spiral coiled component in which a coil has a planar spiral shape as disclosed in, for example, EP-A-435160 or a spatial spiral laminated coiled component in which a ferrite magnetic layer and a coil conductive layer are laminated on one another alternately as disclosed in, for example, Japanese Patent Publication No. 57-39521 (1982) is known as a coiled component satisfying such requirements. In this spatial spiral laminated coiled component, a ferrite layer 51 is formed on about a half of a ferrite green sheet 50 by printing as shown in FIGS. 35 and 36. A substantially L-shaped conductive pattern 52 is formed by printing on a portion of the ferrite green sheet 50 free from the ferrite layer 51 and a portion of the ferrite layer 51. Then, a ferrite layer 53 having a size equal to about a half of that of the green sheet 50 is printed on the conductive pattern 52 and a U-shaped conductive pattern 54 is printed on the ferrite layer 51 and a portion of the ferrite layer 53 so as to be connected to the conductive pattern 52. After repeating this process several times, the substantially L-shaped conductive pattern 52 is printed and then, the ferrite green sheet 50 is laminated on this uppermost conductive pattern 52. Subsequently, this laminated structure is finally subjected to collective firing and electrodes 55 are, respectively, provided on opposite end faces of the laminated structure.

In order to achieve high inductance in the known laminated coiled component of the above described construction, the number of the conductive patterns 54 should be increased. As a result, since an extremely large number of the ferrite layers 53 and the conductive patterns 54 should be laminated on one another by printing, the number of production processes increases, thereby resulting in poor productivity. Furthermore, since the conductive patterns 54 are formed through the ferrite layers 51 and 53 so as to confront each other, stray capacity between the conductive patterns 54 becomes large, so that self resonant frequency and withstand voltage of the known laminated coiled component decrease undesirably.

Furthermore, in the known laminated coiled component, each of the conductive patterns 52 and 54 is formed on the portion of each of the ferrite layers 51 and 53. Thus, if thickness of the conductive patterns 52 and 54 is increased so as to reduce electric resistance of the coiled component, each lamination differs greatly in thickness between a portion having the conductive pattern 52 or 54 and the remaining portion having no conductive pattern 52 or 54. Therefore, even if the laminated structure is subjected to firing, the laminated structure is likely to crack and thus, the known laminated coiled component does not have a sufficiently stable quality.

SUMMARY OF THE INVENTION

Accordingly, the present invention has for its object to provide, with a view to eliminating the above mentioned disadvantages of prior art, a coiled component which is high in productivity and has excellent electrical characteristics such as reduced stray capacity.

In order to accomplish this object, a coiled component according to the present invention comprises: an insulating member; a conductive member which is provided in the insulating member and has a plurality of turns gradually different, in diameter, from each other from one end towards the other end of the conductive member such that at least the turns of the conductive member are disposed in different planes, respectively; and a magnetic layer which is provided on at least one of upper and lower faces of the insulating member.

In accordance with the present invention, an coiled component having high productivity and excellent electrical characteristics is obtained.

This object and features of the present invention will become clear from the following description taken in conjunction with the preferred embodiments thereof with reference to the accompanying drawings throughout which like parts are designated by like reference numerals.

DETAILED DESCRIPTION OF THE INVENTION

Hereinafter, preferred embodiments of the present invention are described with reference to the attached drawings.

Figure 1:
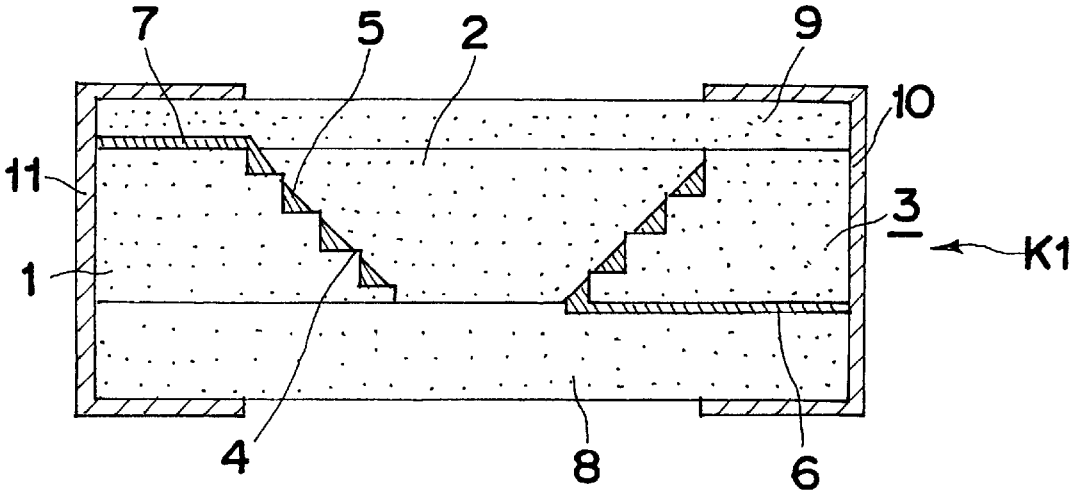
FIG. 1 is a sectional view of a coiled component according to a first embodiment of the present invention.

Initially, FIG. 1 shows a coiled component K1 according to a first embodiment of the present invention. The coiled component K1 includes an insulating member 3 which is constituted by an outer insulating member 1 and an inner insulating member 2. A hollow 4 having a shape of a cone frustum or a pyramid frustum is formed at a central portion of the outer insulating member 1 and an oblique surface of the hollow 4 is formed into a spirally steplike shape. A conductive member 5 is provided on the spiral step of the hollow 4 so as to have a triangular sectional shape. Therefore, by forming the conductive member 5 on the spiral step of the hollow 4, the conductive member 5 defines a hollow having a shape of a cone frustum or a pyramid frustum, in which the inner insulating member 2 is formed.

Meanwhile, the conductive member 5 has a circular three-dimensional spiral shape or a polygonal three-dimensional spiral shape decreasing in diameter downwardly from an upper end towards a lower end of the conductive member 5 and can be provided by filling silver paint or the like on the spiral step of the hollow 4 of the outer insulating member 1. A lead-out electrode 6 is formed at one end of a lower face of the outer insulating member 1 so as to be connected to a lower end of the conductive member 5, while a lead-out electrode 7 is formed at the other end of an upper face of the outer insulating member 1 so as to be connected to an upper end of the conductive member 5.

An upper magnetic layer 9 and a lower magnetic layer 8 are provided on upper and lower faces of the thus obtained structure, respectively. Then, end face electrodes 10 and 11 are provided on opposite end faces of this laminate of the insulating member 3 and the upper and lower magnetic layers 9 and 8 so as to be electrically connected to the lead-out electrodes 6 and 7, respectively such that the chip type coiled component K1 is obtained.

In the above described arrangement of the coiled component K1, the outer insulating member 1 and the inner insulating member 2 may be made of non-magnetic material or magnetic material. Any electrical insulating material including organic insulating material such as glass epoxy, polyimide, etc. and inorganic insulating material such as glass, glass ceramics and ceramics may be employed as the non-magnetic material. Well-known NiZn series or NiZnCu series ferrite material having large permeability may be employed as the magnetic material.

In case the outer insulating member 1 is made of non-magnetic material and the inner insulating member 2 is made of magnetic material, a drum type core is formed by the inner insulating member 2 and the end face electrodes 10 and 11, so that self resonant frequency of the coiled component K1 is raised and thus a frequency band usable in the coiled component K1 widens. On the other hand, in case the outer insulating member 1 is made of magnetic material and the inner insulating member 2 is made of non-magnetic material, the coiled component K1 has a completely closed magnetic circuit, so that its inductance is increased and its leakage flux can be reduced greatly. Furthermore, in case the outer insulating member 1 and the inner insulating member 2 are made of magnetic material, a completely closed magnetic circuit is formed, so that its inductance is increased and its leakage flux is lessened.

Meanwhile, in case the outer and inner insulating members 1 and 2 are made of magnetic materials having different magnetic flux densities, respectively, DC overlap characteristics can be improved. For example, if magnetic flux density of the magnetic materials disposed at small diameter portions of turns of the conductive member 5 is increased, DC overlap characteristics can be raised without the need for changing the three-dimensional layout of the conductive member 5. In addition, alternatively, if magnetic flux density of the outer insulating member 1 is raised when thickness of the outer insulating member 1 has been reduced, DC overlap characteristics can be raised likewise.

Moreover, in case the outer and inner insulating members 1 and 2 are made of magnetic materials having different permeabilities, respectively, the coiled component K1 of the same construction of the conductive member 5 has different inductances. In this case, it does not matter whether or not the permeability of the outer insulating member 1 is larger than that of the inner insulating member 2.

By properly selecting magnetic properties of the outer and inner insulating members 1 and 2 as described above, inductance of the coiled component K1 can be changed arbitrarily and it becomes possible to easily control leakage flux or DC overlap characteristics.

Meanwhile, the conductive member 5 and the lead-out electrodes 6 and 7 may be made of any electrically good conductor. However, since resistivity is vital in the coiled component and the coiled component is required to have low electric resistance, conductors such as copper, silver and alloy of silver and palladium can be effectively employed.

On the other hand, the upper and lower magnetic layers 9 and 8 may be made of NiZn series or NiZnCu series insulating ferrite material and MnZn series conductive ferrite material. In case the upper and lower magnetic layers 9 and 8 are made of the conductive ferrite material, the end face electrodes 10 and 11 are not provided and plating or the like is performed on the upper and lower magnetic layers 9 and 8 so as to act as the end face electrodes 10 and 11. Alternatively in this case, insulating layers are formed at portions corresponding to the lead-out electrodes 6 and 7 and portions corresponding to the end face electrodes 10 and 11 so as to insulate them, thereby resulting in electrostatic shielding effect.

Meanwhile, the end face electrodes 10 and 11 may be made of any electrically conductive material but generally are each formed by not a single layer but a plurality of a layers desirably. In case the end face electrodes 10 and 11 are of surface mounting type, mounting strength of the end face electrodes 10 and 11 or wetting of solder and solder penetration on the end face electrodes 10 and 11 at the time of their mounting on a printed-wiring board should be taken into consideration. More specifically, the same conductive material as that of the lead-out electrodes 6 and 7 is employed for the lowermost layer, nickel resistant to solder is employed for an intermediate layer and solder or tin having excellent wetting against solder is employed for the outermost layer.

However, this arrangement is merely one example and thus, is not necessarily required to be employed. Therefore, material having excellent electrical conductivity, for example, metal may be replaced by electrically conductive resinous material.

Figure 2:
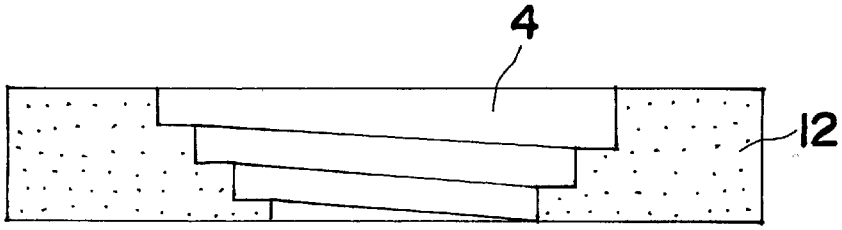
FIG. 2 is a sectional view of an outer insulating member of the coiled component of FIG. 1 during its production.
Figure 3:
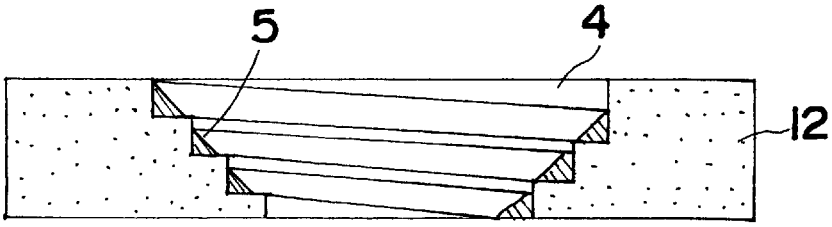
FIG. 3 is a sectional view in which a conductive member is provided on the outer insulating member of FIG. 2.

Hereinafter, a method of producing the coiled component K1 of the above described arrangement is described with reference to FIGS. 2 to 7. Initially, as shown in FIG. 2, a rather thick green sheet 12 made of non-magnetic material or magnetic material and acting as the outer insulating member 1 is prepared and the hollow 4 having the shape of the cone frustum or the pyramid frustum is formed on the green sheet 12 spirally and stepwise. Then, as shown in FIG. 3, silver paint is provided on the spiral step of the hollow 4 of the green sheet 12 by application, printing, etc. so as to define an oblique surface of the cone frustum or the pyramid frustum. However, at this time, an edge of each turn of the spiral step of the hollow 4 should be exposed such that the silver paint portions provided on neighboring turns of the spiral step are not electrically conducted to each other.

Figure 4:
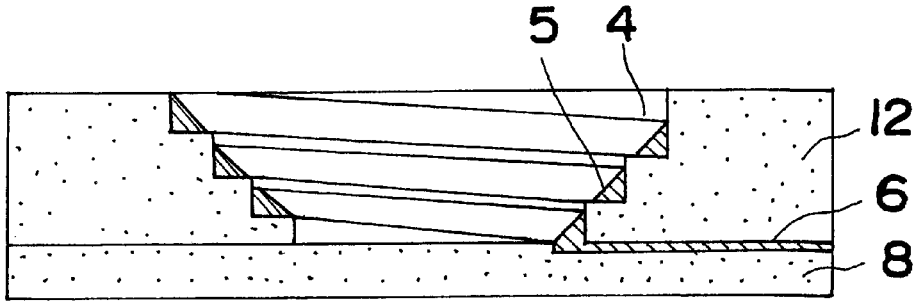
FIG. 4 is a sectional view in which the outer insulating member of FIG. 3 is laminated on a lower magnetic layer.

Subsequently, as shown in FIG. 4, the lead-out electrode 6 is formed by printing or the like on an upper face of a green sheet so as to obtain the lower magnetic layer 8. The green sheet 12 of FIG. 3 is laminated on the lower magnetic layer 8 such that one end of the silver paint acting as the conductive member 5 is brought into contact with one end of the lead-out electrode 6.

Figure 5:
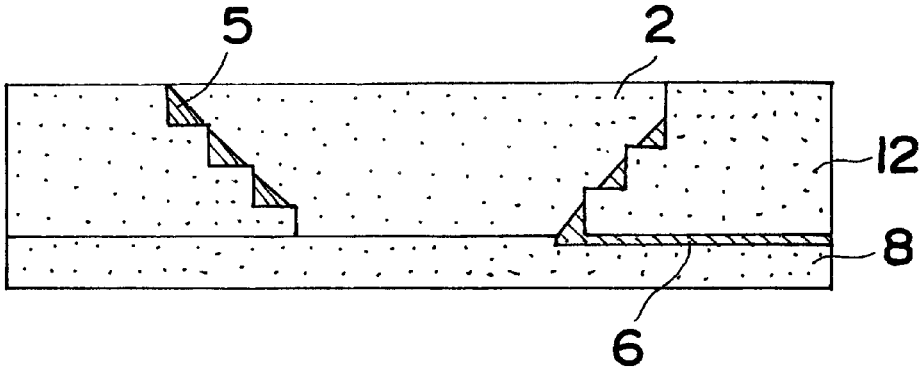
FIG. 5 is a sectional view in which an inner insulating member is formed in the outer insulating member of FIG. 4.
Figure 6:
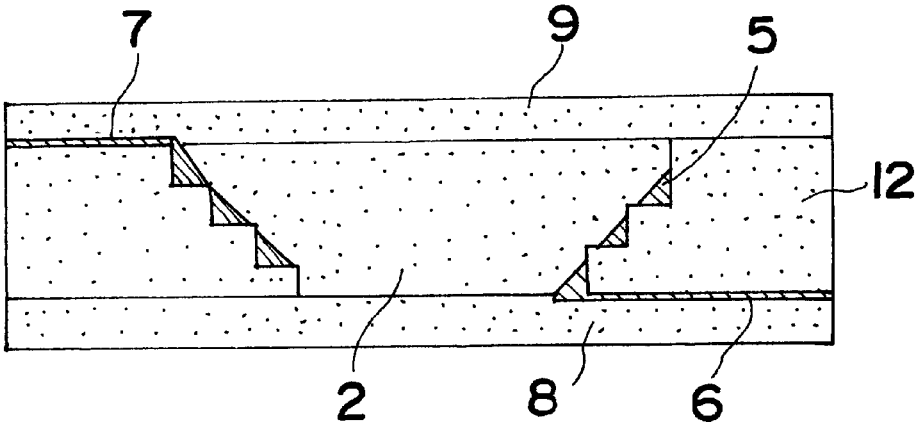
FIG. 6 is a sectional view in which an upper magnetic layer is laminated on the outer insulating member of FIG. 5.

Thereafter, as shown in FIG. 5, magnetic or non-magnetic paste acting as the inner insulating member 2 is filled in the hollow 4 of the green sheet 12. Then, as shown in FIG. 6, the upper magnetic layer 9 on a lower face of which the lead-out electrode 7 is printed is laminated on the laminate of FIG. 5 such that the other end of the silver paint acting as the conductive member 5 is brought into contact with one end of the lead-out electrode 7.

Figure 7:
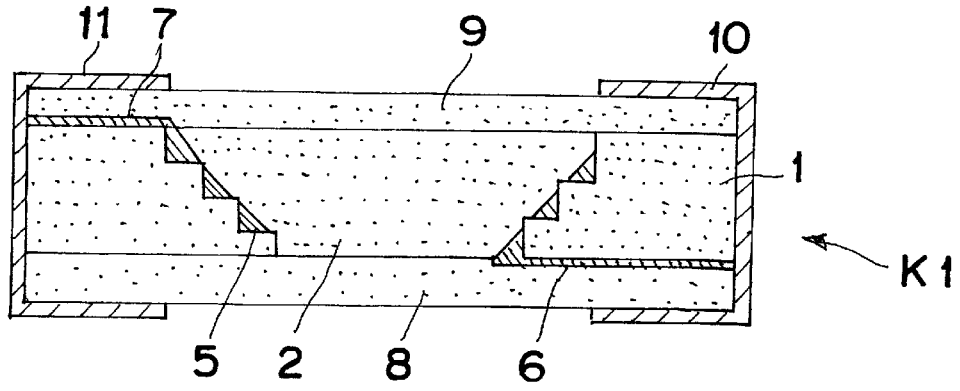
FIG. 7 is a sectional view of the coiled component of FIG. 1 after completion of its production.

The thus obtained laminate is placed in a firing furnace so as to be subjected to firing at a temperature of not less than 850° C. Then, as shown in FIG. 7, the end face electrodes 10 and 11 are formed on the opposite end faces of the laminate so as to be electrically connected to the lead-out electrodes 6 and 7, respectively and thus, the coiled component K1 is obtained.

This production method is merely one basic example. However, in this production method, its process is quite simple and the number of its operational steps is small, thereby resulting in quite excellent productivity.

Figure 8:
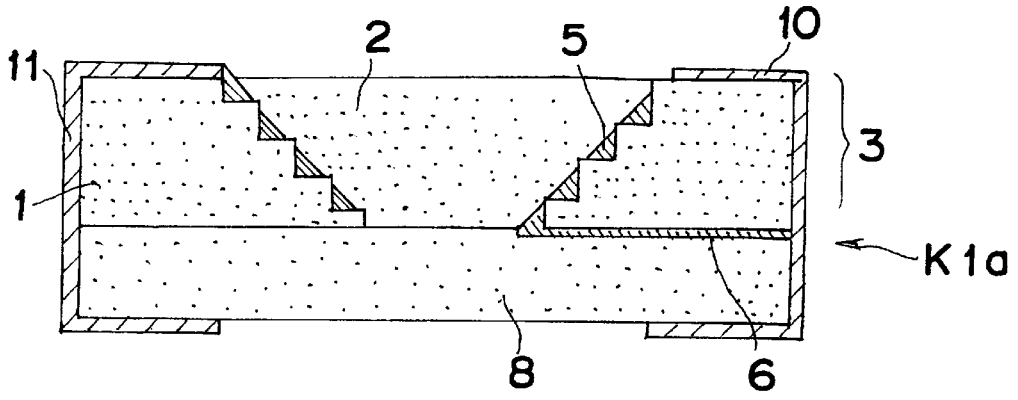
FIGS. 8 to 14 are views similar to FIG. 7, particularly showing its first to seventh modifications, respectively.

FIG. 8 shows a coiled component K1*a* which is a first modification of the coiled component K1. In the coiled component K1*a*, only the lower magnetic layer 8 is provided on the lower face of the insulating member 3 by eliminating the upper magnetic layer 9 and the end face electrode 11 acts also as the lead-out electrode 7 formed on the upper face of the insulating member 3. The coiled component K1*a* offers, a minor problem with respect to leakage flux but has a simpler and thinner arrangement advantageously. Meanwhile, contrary to the arrangement of FIG. 8, only the upper magnetic layer 9 may be formed on the upper face of the insulating member 3 by eliminating the lower magnetic layer 8.

Figure 9:
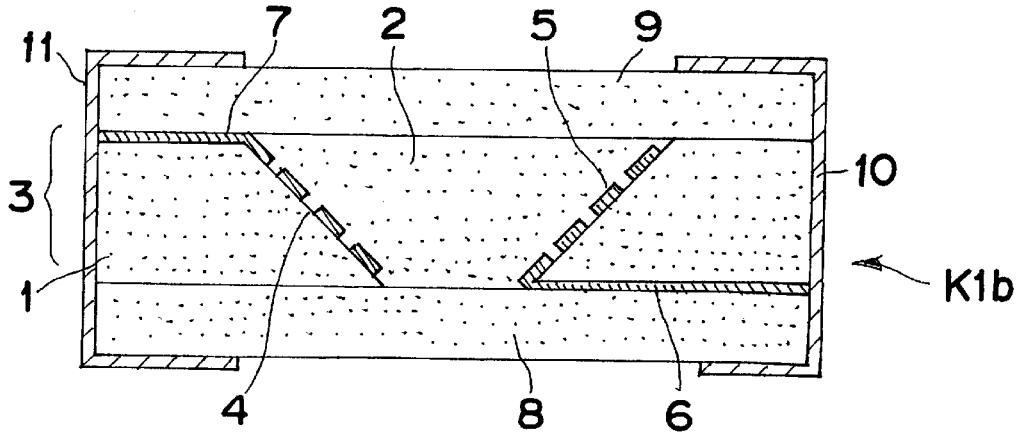

FIG. 9 shows a coiled component K1*b* which is a second modification of the coiled component K1. In the coiled component K1*b*, the hollow 4 of the outer insulating member 1 is formed into a shape of a complete cone frustum or a complete pyramid frustum. The conductive member 5 having a predetermined width is wound on an oblique surface of the hollow 4 a plurality of turns. Then, the inner insulating member 2, the lead-out electrodes 6 and 7, the upper and lower magnetic layers 9 and 8 and the end face electrodes 10 and 11 are formed and thus, the coiled component K1*b* is obtained. In this arrangement of the coiled component K1*b*, the conductive member 5 can be formed quite easily, thereby resulting in improvement of its productivity. Meanwhile, without being formed on the oblique surface of the hollow 4 of the outer insulating member 1, the conductive member 5 may also be formed on an outer periphery of the inner insulating member 2, which has the shape of the cone frustum or the pyramid frustum such that the inner insulating member 2 having the conductive member 5 is assembled into the hollow 4 of the outer insulating member 1.

Figure 10:
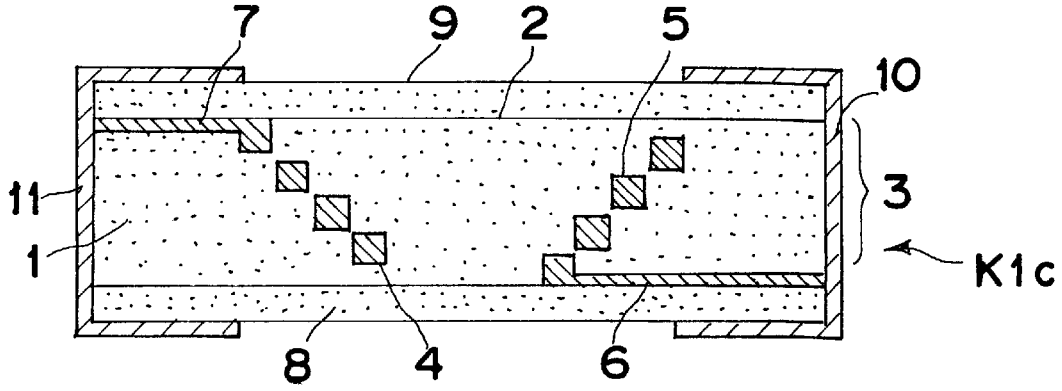
Figure 11:
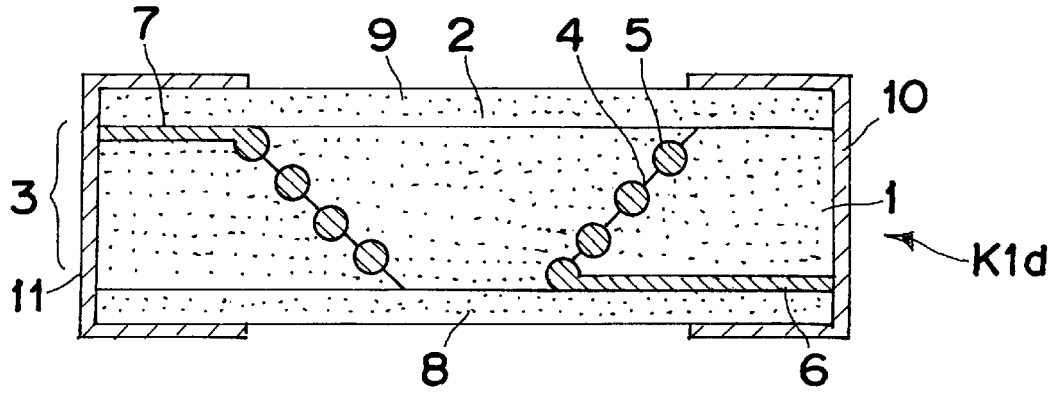
Figure 12:
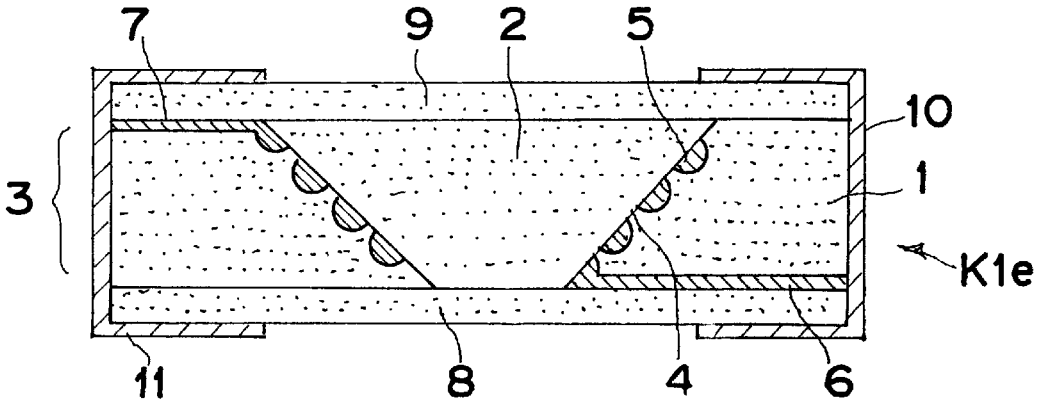

Meanwhile, FIGS. 10, 11 and 12 show coiled components K1*c*, K1*d* and K1*e* which are third, fourth and fifth modifications of the coiled component K1, respectively. In the coiled components K1*c*, K1*d* and K1*e*, the conductive member 5 has square, circular and semicircular sectional shapes, respectively so as to have large sectional area leading to low electric resistance such that large electric current can be applied to the coiled components K1*c*, K1*d* and K1*e*.

In order to form the conductive member 5 into a square sectional shape as shown in FIG. 10, a first spiral step is provided on the oblique surface of the hollow 4 of the outer insulating member 1 such that a first conductive member portion having a triangular sectional shape is formed on the first spiral step, while a second spiral step is also provided on the outer periphery of the inner insulating member 2 such that a second conductive member portion having a triangular sectional shape is formed on the second spiral step. Thus, the first and second conductive member portions each having the triangular sectional shape are assembled into the conductive member 5 having the square sectional shape.

In order to form the conductive member 5 into a circular sectional shape as shown in FIG. 11, a first semicircular spiral groove is provided on the oblique surface of the hollow 4 in place of the first spiral step such that a first conductive member portion having a semicircular sectional shape is filled into the first semicircular spiral groove, while a second semicircular spiral groove is provided on the outer periphery of the inner insulating member 2 in place of the second spiral step such that a second conductive member having a semicircular sectional shape is filled into the second semicircular spiral groove. Thus, the first and second conductive member portions each having the semicircular sectional shape are assembled into the conductive member 5 having the circular sectional shape.

In order to form the conductive member 5 into a semicircular sectional shape as shown in FIG. 12, a semicircular spiral groove is formed on one of contact surfaces of the outer and inner insulating members 1 and 2 and then, silver paint or the like is filled into the semicircular spiral groove.

Figure 13:
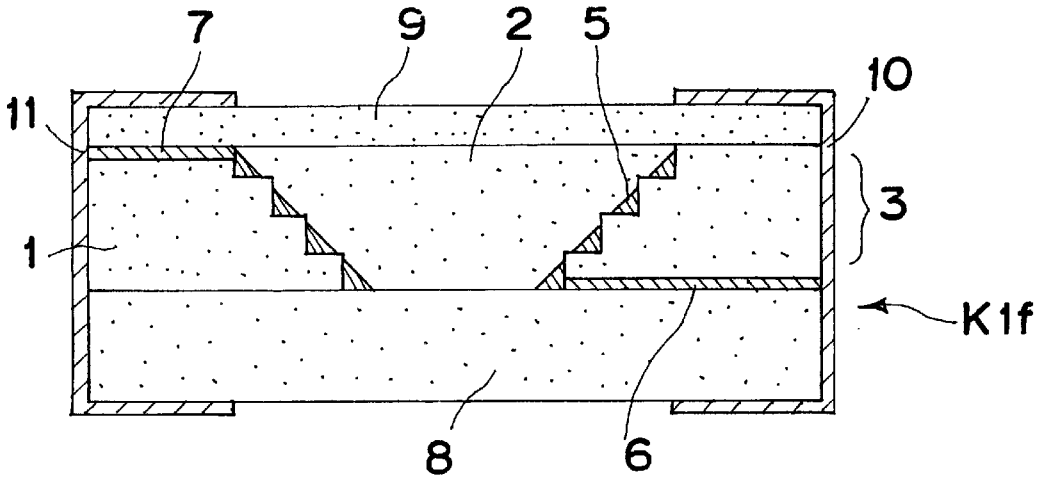

FIG. 13 shows a coiled component K1*f* which is a sixth modification of the coiled component K1. In the coiled component K1*f*, the conductive member 5 is wound four turns and each turn of the conductive member 5 is disposed in an identical plane. Upwardly and downwardly extending portions are formed at a terminal end and an initial end of each turn of the conductive member 5 so as to be connected to adjoining upper and lower turns of the conductive member 5, respectively. In order to obtain this arrangement, a step is formed on the oblique surface of the hollow 4 having the shape of the cone frustum or the pyramid frustum and the conductive member 5 is formed on the step such that the terminal end and the initial end of each turn of the conductive member 5 are connected to the adjoining upper and lower turns of the conductive member 5, respectively. On the contrary, a step may also be formed on the outer periphery of the inner insulating member 2 such that the conductive member 5 is formed on the step.

Figure 14:
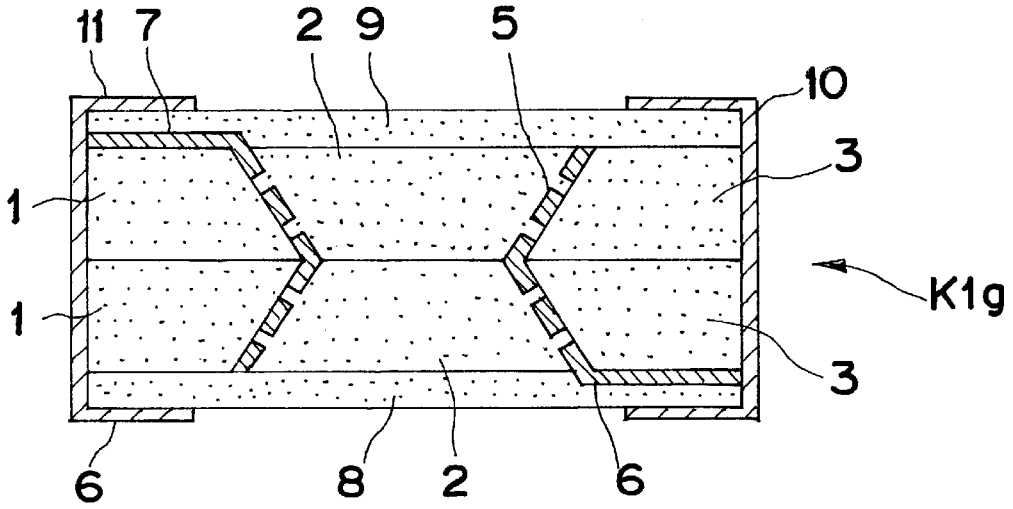

FIG. 14 shows a coiled component K1*g* which is a seventh modification of the coiled component K1. In the coiled component K1*g*, a pair of the insulating members 3 each including the conductive member 5 of the arrangement of FIG. 9 are laminated on each other such that small-diameter portions of the conductive members 5 of the insulating members 3 abut on each other. Subsequently, the upper and lower magnetic layers 9 and 8 are provided on upper and lower faces of this laminate and then, the end face electrodes 10 and 11 are provided. In the conductive member 5 of the coiled component K1*g* of this arrangement, a pair of turns having an identical diameter exist. However, since the turns having the identical diameter are rather distant from each other, stray capacity produced therebetween is substantially negligible.

In the first embodiment and its various modifications of the present invention referred to above, if the conductive member 5 is formed such that a gap is not visible between neighboring ones of the turns of the conductive member 5 when the conductive member 5 is observed from its large-diameter portion, magnetic flux whirling through only each turn of the conductive member 5 is lessened and ratio of area of space occupied by the conductive member 5 to limited area for providing the conductive member 5 can be increased. Therefore, DC resistance can be reduced. As a result, inductance of the coiled component can be increased.

Accordingly, in the coiled component according to the first embodiment and its modifications of the present invention, the conductive member 5 is continuously formed on the oblique surface of the hollow of the outer insulating member 1 or the oblique surface of the outer periphery of the inner insulating member 2 and the magnetic layers 9 and 8 are provided on at least one of the upper and lower faces of the laminate. Therefore, in contrast with prior art laminated structures, productivity and yield are raised in the present invention.

Meanwhile, in the present invention, since the neighboring ones of the turns of the conductive member 5 do not confront each other facially, production of stray capacity is minimized and self resonant frequency is lowered. Accordingly, if the coiled component of the present invention is used as a filter or the like, large attenuation is performed in a broad band.

Furthermore, in the present invention, since the upper and lower magnetic layers 9 and 8 are provided on the outermost layer of the coiled component, leakage flux can be reduced and inductance can be increased regardless of whether the coiled component has a closed magnetic circuit or an open magnetic circuit.

Meanwhile, in the above description of the first embodiment and its modifications of the present invention, the coiled component is of facial mounting type in which the end face electrodes 10 and 11 are provided on the opposite end faces of the coiled component. However, the coiled component may be further modified such that terminal, pins are provided on the insulating member 3 or the upper and lower magnetic layers 9 and 8 or capped electrodes are fitted around opposite ends of the coiled component in place of the end face electrodes 10 and 11.

Figure 15:
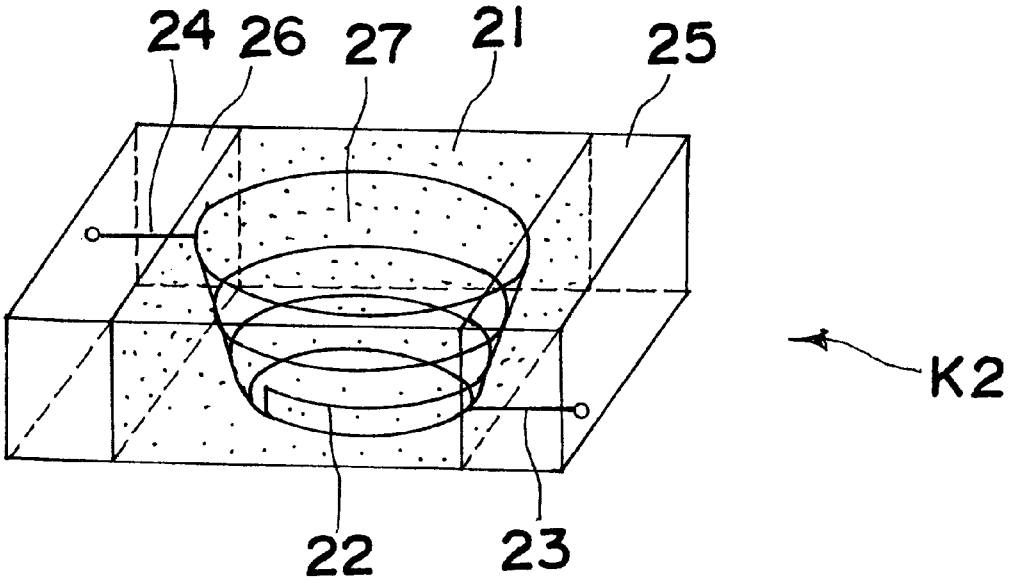
FIG. 15 is a schematic perspective view of a coiled component according to a second embodiment of the present invention.

FIG. 15 shows a coiled component K2 according to a second embodiment of the present invention. A conductive member 22 having a plurality of turns is provided on a peripheral surface of a hollow of an outer insulating member 21. The hollow has a shape of a cone frustum or a pyramid frustum and is formed at a central portion of the outer insulating member 21. The conductive member 22 is formed such that diameter of each of the turns of the conductive member 22 gradually increases from one end towards the other end of the conductive member 22. Furthermore, the respective turns of the conductive member 22 are disposed in different planes. Namely, a turn of the conductive member 22 at its one end is formed by a circle having a small diameter and circular diameters of the remaining turns of the conductive member 22 increase gradually towards the other end of the conductive member 22. An upwardly or downwardly extending portion is formed at a terminal end or an initial end of each turn of the conductive member 22 so as to be connected to an adjoining upper or lower turn of the conductive member 22. Therefore, each turn of the conductive member 22 is disposed in an identical plane, while the adjoining turns of the conductive member 22 are disposed in different planes and have different diameters. In the example of FIG. 15, about one turn of the conductive member 22 is present in an identical plane but a plurality of turns of the conductive member 22 may be provided in an identical plane in the same manner as a well-known planar spiral coil.

An inner insulating member 27 having a size substantially equal to that of the hollow of the outer insulating member 21, which has the shape of the cone frustum or the pyramid frustum is provided at the central portion of the outer insulating member 21 such that the conductive member 22 is surrounded by the outer insulating member 21 and the inner insulating member 27.

Lead-out electrodes 23 and 24 are, respectively, provided at opposite ends of the conductive member 22 so as to be connected to end face electrodes 25 and 26 which are provided on opposite end faces of the outer insulating member 21. As shown in FIG. 15, each turn of the conductive member 22 represents a conductor disposed in an identical plane. Namely, in the example shown in FIG. 15, the respective turns of the conductive member 22 are disposed in four planes, respectively.

Figure 16:
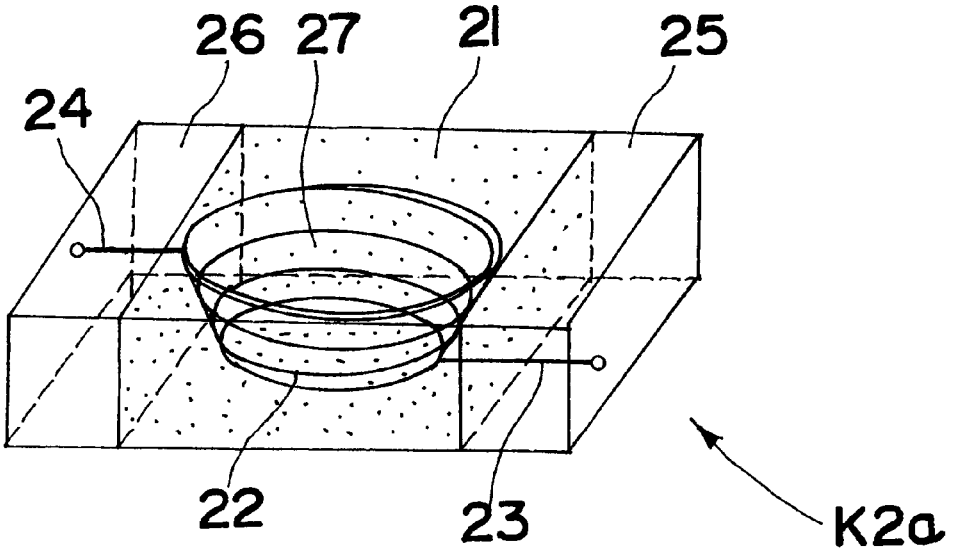
FIG. 16 is a view similar to FIG. 15, particularly showing its first modification.

FIG. 16 shows a coiled component K2*a* which is a first modification of the coiled component K2. In the coiled component K2, the conductive member 22 is formed into a three-dimensional spiral shape such that not only diameter of each of turns of the conductive member 22 increases gradually from one end towards the other end of the conductive member 22 but all locations in the conductive member 22 is disposed in different planes. Other constructions of the coiled component K2*a* are similar to those of the coiled component K2 of FIG. 15. Namely, in the coiled component K2*a*, pattern of the conductive member 22 obtained by an operational step for forming the conductive member 22, in which, for example, the conductive member 22 having a plurality of turns different, in diameter, gradually from one end towards the other end of the conductive member 22 such that at least the respective turns of the conductive member 22 are disposed in different planes.

Figure 17:
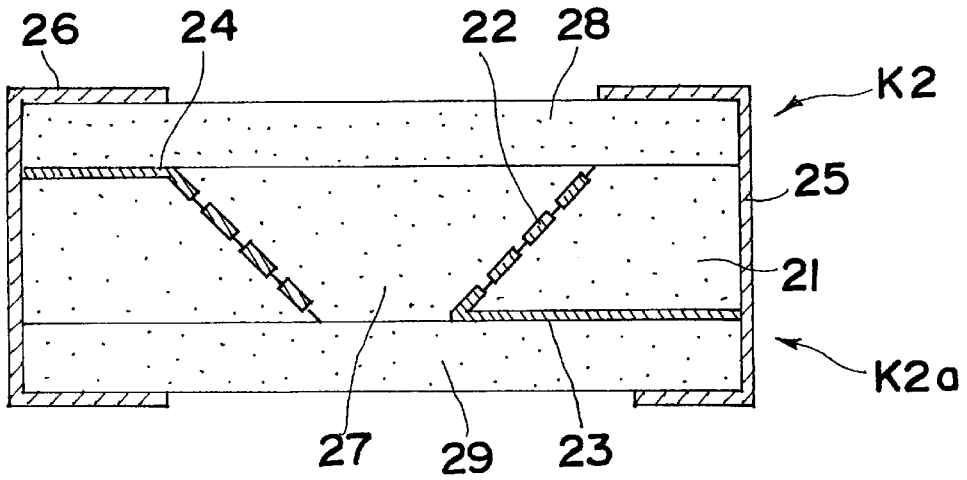
FIG. 17 is a sectional view of the coiled components of FIGS. 15 and 16.

FIG. 17 shows the coiled components K2 and K2*a*. In FIG. 17, the conductive member 22 is formed on the peripheral surface of the hollow of the outer insulating member, which has the shape of the cone frustum or the pyramid frustum or the outer periphery of the inner insulating member 27, which has the shape of the cone frustum or the pyramid frustum. Each of the outer insulating member 21, the inner insulating member 27 and upper and lower magnetic layers 28 and 29 is made of a single material which may be non-magnetic or magnetic. Any electrical insulating material including organic insulating material such as glass epoxy, polyimide, etc. and inorganic insulating material such as glass, glass ceramics and ceramics may be employed as the non-magnetic material. Meanwhile, well-known NiZn series or NiZnCu series ferrite material having large permeability may be employed as the magnetic material.

In case the outer insulating member 21 or the inner insulating member 27 is made of magnetic material, inductance can be increased. On the other hand, in case the outer insulating member 21 or the inner insulating member 27 is made of non-magnetic material, large inductance cannot be obtained but self resonant frequency rises, so that usable frequency band widens.

Furthermore, each of the outer insulating member 21, the inner insulating member 27 and the upper and lower magnetic layers 28 and 29 may also not be required to be made of a single electrical insulating material. For example, the inner insulating member 27 may be made of not less than two kinds of electrical insulating materials. By combining various electrical insulating materials, especially, electrical insulating materials having different magnetic properties, electrical characteristics of the coiled component K2 can be changed arbitrarily. For example, inductance and DC overlap characteristics can be adjusted, a countermeasure against leakage flux can be taken and usable frequency band can be controlled.

Meanwhile, the conductive member 22 and the lead-out electrodes 23 and 24 may be made of any electrically good conductor. However, since resistivity is vital in the coiled component and the coiled component is required to have low electric resistance, conductors such as copper, silver and alloy of silver and palladium can be effectively employed.

The end face electrodes 25 and 26 are made of any electrically conductive material. However, generally, it is desirable that each of the end face electrodes 25 and 26 is formed by not a single layer but a plurality of layers. In case the end face electrodes 25 and 26 are of surface mounting type, mounting strength of the end face electrodes 25 and 26 or wetting of solder and solder penetration on the end face electrodes 25 and 26 at the time of their mounting on a printed-wiring board should be taken into consideration. More specifically, the same conductive material as that of lead-out electrodes 23 and 24 is employed for the lowermost layer, nickel resistant to solder is employed for an intermediate layer and solder or tin having excellent wetting against solder is employed for the outermost layer. However, this arrangement is merely one example and thus, is not necessarily required to be employed. Therefore, material having excellent electrical conductivity, for example, metal may be replaced by electrically conductive resinous material.

Meanwhile, in case after a predetermined wiring pattern has been formed on a substrate of ceramics such as alumina or ferrite and the coiled component has been inserted into a window formed on the ceramic substrate, the wiring pattern and the end face electrodes 25 and 26 are brought into contact with each other and are subjected to firing by utilizing a thick film forming process so as to be electrically connected to each other, heat resistance of the end face electrodes 25 and 26 may be raised such that the end face electrodes 25 and 26 have an arrangement suitable for this thick film forming process.

Figure 18:
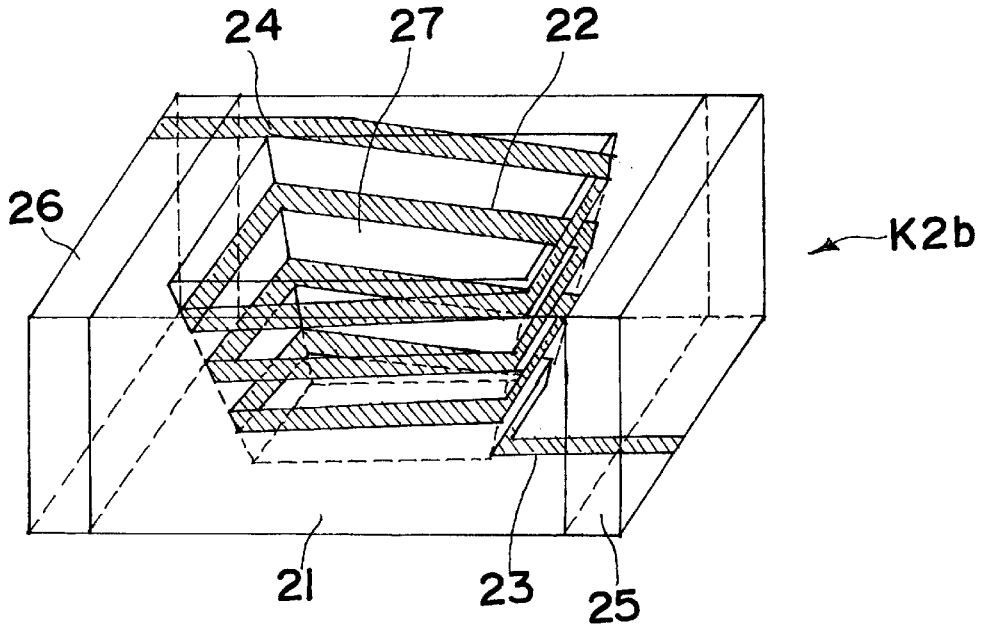
FIG. 18 is a view similar to FIG. 15, particularly showing its second modification.

FIG. 18 shows a coiled component K2*b* which a second modification of the coiled component K2. In the coiled components K2 and K2*a* of FIGS. 15 and 16, each turn of the conductive member 22 has a circular shape. However, in surface mounting type coiled components, the conductive member may preferably have a shape of a pyramid frustum. In this case, each turn of the conductive member has a polygonal shape so as to extend substantially to external shape of the coiled component. This can be achieved by forming the conductive member 22 between the outer insulating member 21 and the inner insulating member 27 having the shape of the pyramid frustum. In FIG. 18, the conductive member 22 is formed into a polygonal three-dimensional spiral shape. However, the coiled component K2*b* can also be set to an arrangement in which each polygonal turn of the conductive member 22 is disposed in an identical plane and a terminal end and an initial end of each turn of the conductive member 22 are connected to adjoining turns of the conductive member 22, respectively.

In the second embodiment and its modifications of the present invention referred to above, since the conductive member 22 is continuously formed on the oblique surface or a steplike oblique surface of the imaginary cone frustum or pyramid frustum in the insulating member, the coiled component can be produced easily and yield of the coiled component can be raised in contrast with conventional lamination method. Meanwhile, in the coiled component obtained by such a production method, since neighboring turns of the conductive member 22 do not confront each other facially through the insulating member, production of stray capacity is minimized and thus, self resonant frequency is lessened. Therefore, if the coiled component is used as a filter or the like, large attenuation is performed in a broad band, so that the coiled component has remarkably excellent quality and performance.

Meanwhile, in above description of the second embodiment and its modifications of the present invention, the coiled component is of facial mounting type in which the end face electrodes are provided on the opposite end faces of the coiled component. However, the coiled component may also have an arrangement in which terminal pins are provided on the insulating member or a lead type arrangement in which capped electrodes having terminals in place of the end face electrodes are fitted around opposite ends of the coiled component.

Figure 19:
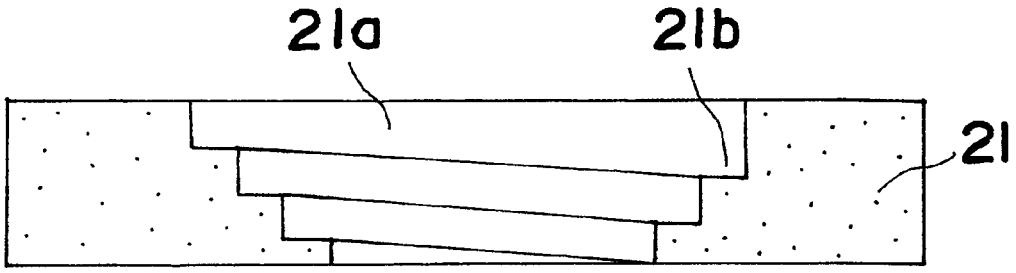
FIG. 19 is a sectional view of an outer insulating member of the coiled component of FIG. 15 during its production.

Hereinafter, a method of producing the coiled component K2 is sequentially described with reference to FIGS. 19 to 24. Initially, as shown in FIG. 19, a three-dimensional spiral step 21*b* is formed on a peripheral surface of a conical or pyramidal hollow 21*a* formed at a central portion of the outer insulating member 21. Then, the conductive member 22 is formed on the step 21*b* so as to have a plurality of turns gradually different, in diameter, from each other from one end towards the other end of the conductive member 22 such that at least the respective turns of the conductive member 22 are disposed in different planes.

The hollow 21*a* may have a simple conical shape or a pyramidal shape and the conductive member 22 is formed on the peripheral surface of the hollow 21*a* so as to have a plurality of the turns gradually different, in diameter, from each other from the one end towards the other end of the conductive member 22 such that at least the respective turns of the conductive member 22 are disposed in the different planes. On the other hand, if the hollow 21*a* has a steplike peripheral surface in place of the simple oblique surface and the conductive member 22 is formed, for example, at a corner of the step, the conductive member 22 should have a plurality of the turns gradually different, in diameter, from each other from one end towards the other end of the conductive member 22 such that at least the respective turns of the conductive member 22 are disposed in the different planes.

In a further concrete example of the conductive member 22, each turn of the conductive member 22 is disposed in an identical plane from an initial to a terminal end of each turn of the conductive member 22 such that the initial end and the terminal end of each turn of the conductive member 22 are connected to adjoining turns of the conductive member 22 or the conductive member 22 is formed into a three-dimensional spiral shape extending from one end to the other end of the conductive member 22 as described above.

In one method of forming the outer insulating member 21 formed with the hollow 21*a* having the peripheral surface of the above mentioned shape, slurry of insulating material is poured onto a base having a boss engageable with the hollow 21*a*. After the slurry has been dried to the outer insulating member 21, the outer insulating member 21 is separated from the base and thus, the specific hollow 21*a* can be formed on the outer insulating member 21. In another method, after slurry of insulating material has been poured onto a flat base so as to obtain the flat sheetlike outer insulating member 21, the specific hollow 21*a* is formed on the outer insulating member 21 by using a die having a shape for forming the hollow 21*a*. Furthermore, alternatively, the hollow outer insulating member 21 having the specific hollow 21*a* can be likewise formed by well-known powder molding method. In any one of these methods, the hollow outer insulating member 21 having the specific hollow 21*a* can be formed as shown in FIG. 19. Furthermore, the peripheral surface of the hollow 21*a* may be oblique or stepwise oblique as described above.

Figure 20:
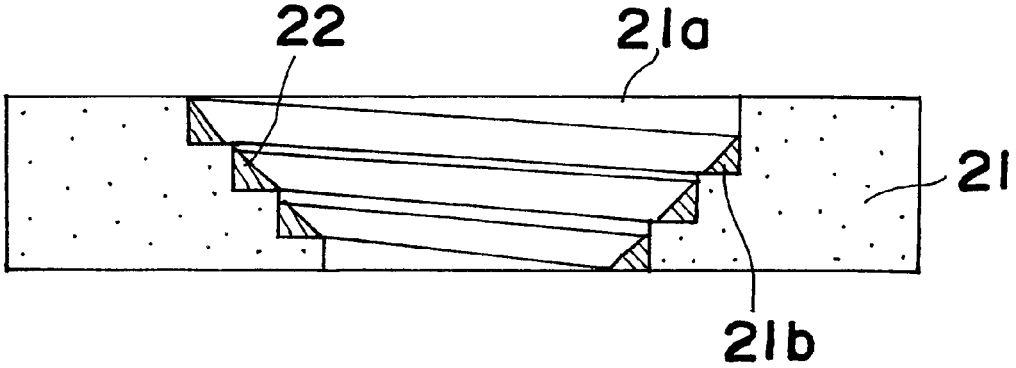
FIG. 20 is a sectional view in which a conductive member is provided on the outer insulating member of FIG. 19.

Subsequently, as shown in FIG. 20, the conductive member 22 is formed on the spiral step of the hollow 21*a* of the outer insulating member 21. The conductive member 22 has a plurality of turns gradually different, in diameter, from each other from one end towards the other end of the conductive member 22 and at least the respective turns of the conductive member 22 are disposed in different planes. As described above, the conductive member 22 may be of a spiral shape obtained by lifting a central portion of a coil fanwise or a shape having a series of concentric circles.

Figure 21:
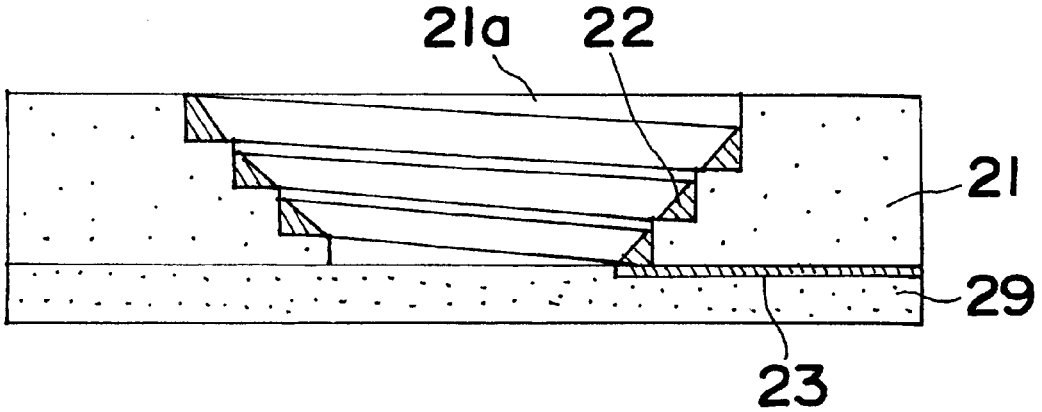
FIG. 21 is a sectional view in which the outer insulating member of FIG. 20 is laminated on a lower magnetic layer.

Then, as shown in FIG. 21, the outer insulating member 21 formed with the conductive member 22 is joined to the lower magnetic layer 29 having the lead-out electrode 23 such that the lead-out electrode 23 is connected to one end of the conductive member 22 in a small-diameter one of the turns of the conductive member 22 on a lower face of the outer insulating member 21.

Figure 22:
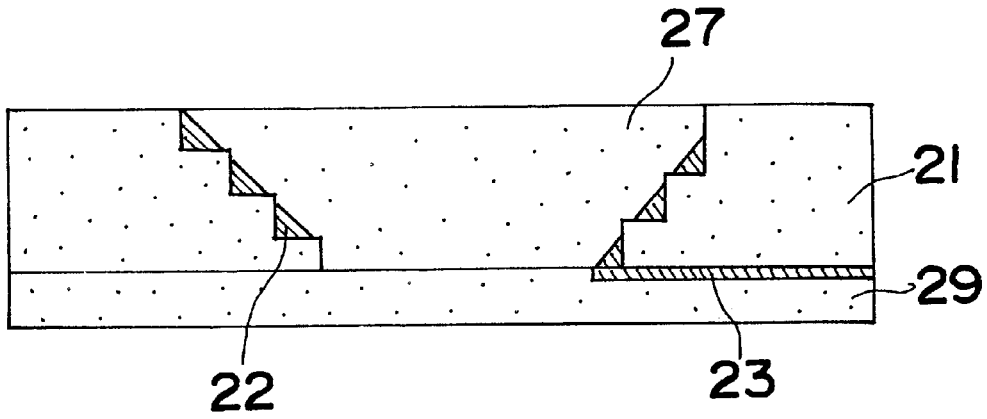
FIG. 22 is a sectional view in which an inner insulating member is formed in the outer insulating member of FIG. 21.

Thereafter, as shown in FIG. 22, the inner insulating member 27 is filled into the hollow 21*a* defined by the outer insulating member 21 and the lower magnetic layer 29.

Figure 23:
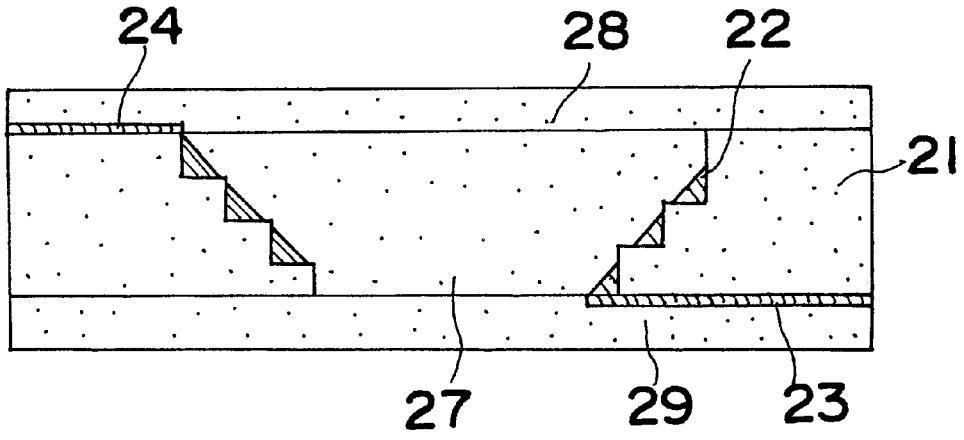
FIG. 23 is a sectional view in which an upper magnetic layer is laminated on the outer insulating member of FIG. 22.

Then, as shown in FIG. 23, the upper magnetic layer 29 having the lead-out electrode 24 is joined to an upper face of the outer insulating member 21 in the same manner as in FIG. 21 such that the lead-out electrode 24 is connected to the other end of the conductive member 22 in a large-diameter one of the turns of the conductive member 22 on the upper face of the outer insulating member 21.

Figure 24:
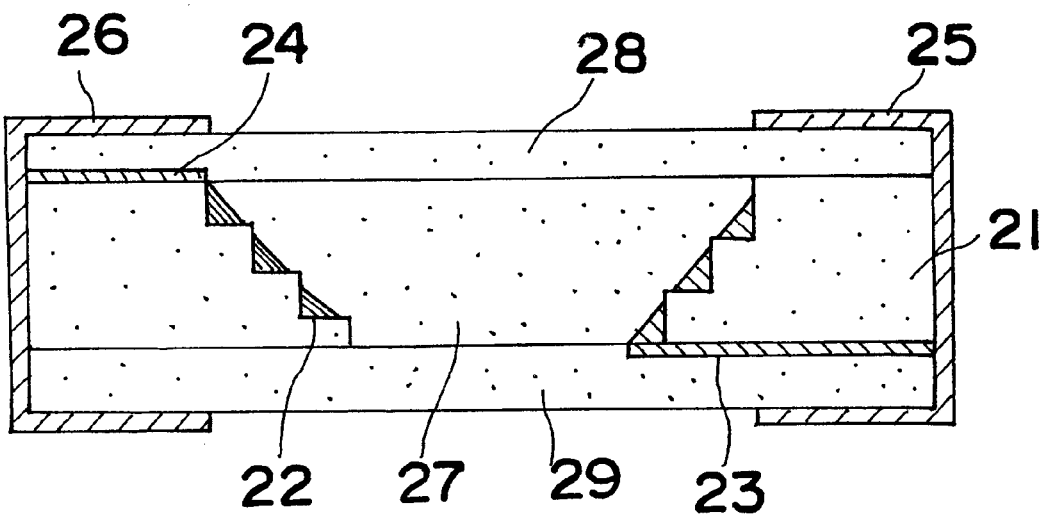
FIG. 24 is a view in which a pair of end face electrodes are formed on opposite end faces of the outer insulating member of FIG. 23, respectively.

Furthermore, as shown in FIG. 24, the end face electrodes 25 and 26 are, respectively, formed on opposite end faces of the chip member of FIG. 23. By subjecting the thus obtained laminate to firing, the coiled component K2 can be obtained. However, firing may also be performed without forming the end face electrodes 25 and 26. In this case, the laminate which does not have the end face electrodes 25 and 26 is subjected to firing and then, the end face electrodes 25 and 26 are formed on the laminate. In one example of formation of the end face electrodes 25 and 26 at this time, conductive layers are formed on the laminate so as to have shape similar to that of the end face electrodes 25 and 26 shown in FIG. 24 and are subjected to firing once. Subsequently, by using the conductive layers as electrodes, the laminate is subjected to nickel plating and soldering or tin plating. Finally, each of the end face electrodes 25 and 26 has a three-layer construction of the substrate conductive layer formed by firing, nickel of electroplating and solder or tin of electroplating.

In the above described example, the conductive member 22 is formed on the peripheral surface of the hollow 21*a* of the outer insulating member 21. However, the conductive member 22 may also be formed on an outer peripheral surface of the inner insulating member 27. Furthermore, by combining the outer insulating member 21 formed with a portion of the conductive member 22 and the inner insulating member 27 formed with the remaining portion of the conductive member 22, a unitary member of the outer insulating member 21, the conductive member 22 and the inner insulating member 27 may also be formed.

The outer insulating member 21, the inner insulating member 27 and the upper and lower electrodes 28 and 29 can be formed by well-known green sheet molding method, printing method, dipping method, powder molding method or spin coating method. Printing method is generally employed for forming the conductive member 22 and the lead-out electrodes 23 and 24 but may be replaced by patterning method using a laser, a method in which a conductor formed preliminarily to a predetermined shape by a die or the like is transferred, dripping method, potting method or flame spraying method.

In the production method of FIGS. 19 to 24, the upper and lower insulating layers, i.e., the upper and lower magnetic layers 28 and 29 are formed so as to be, respectively, brought into contact with upper and lower faces of the hollow insulating member, i.e., the outer insulating member 21 and the solid insulating member, i.e., the inner insulating member 27 but only one of the upper and lower magnetic layers 28 and 29 may also be formed. In this case, the lead-out electrode 23 or 24 is formed on the outer insulating member 21. At this time, if the outer insulating member 21, the inner insulating member 27 and the upper magnetic layer 28 or the lower magnetic layer 29 is made of magnetic material, electrical characteristics of the coiled component are lessened due to its incomplete closed magnetic circuit but DC overlap characteristics of the coiled component are improved.

The coiled component K2 obtained by the above mentioned production method has excellent heat resistance and therefore, can be made modular easily. For example, a predetermined wiring layer is formed on a substrate of ceramics such as alumina and ferrite and the substrate and the coiled component K2 can be made integral or assembled with each other by simultaneously connecting a circuit of the substrate and the end face electrode 25 or 26 to each other. In this case, since the end face electrode 25 or 26 of the coiled component K2 can be connected to the circuit of the substrate by forming a window at a redetermined location of the substrate, a thin module can be obtained. In this case, well-known ordinary thick film forming process utilizing a ceramic substrate can be employed. The end face electrodes 25 and 26 of the coiled component K2 are not necessarily required to be soldered but may also be subjected to firing for electrical connection.

In the coiled component K2, two terminals of the conductive member 22 are electrically connected to the end face electrode 25 and 26 formed on the opposite end faces of the chip member. Namely, the lead-out electrodes 23 and 24 for electrically connecting the conductive member 22 to the end face electrodes 25 and 26 are provided at a lowermost portion and an uppermost portion of the conductive member 22 so as to be connected to the terminal electrodes 25 and 26.

In paste for forming each layer of the coiled component K2, solvent such as butyl Carbitol, terpineol and alcohol, binder such as ethyl cellulose, polyvinyl butyral, polyvinyl alcohol, polyethylen oxide and ethylene-vinyl acetate, firing auxiliary such as various oxides and glass, plasticizer such as butyl benzyl phthalate, dibutyl phthalate and glycerin or dispersant may be added to each powder. Each layer of the coiled component K2 is formed by using a kneaded article in which these substances are mixed with each other. These layers are laminated on one another to the above mentioned predetermined structure and are subjected to firing, so that the coiled component K2 is obtained. In case a green sheet is produced, it is desirable to replace the above mentioned solvent by various solvents having excellent evaporation property, for example, butyl acetate, methyl ethyl ketone, toluene and alcohol.

Firing temperature ranges from about 800 to 1300° C. and changes especially in accordance with material of the conductive member 22. For example, in case the conductive member 22 is made of silver, firing temperature should be set at 900° C. approximately. Meanwhile, in case the conductive member 22 is made of alloy of silver and palladium, firing temperature should be set at 950° C. In order to set firing temperature higher, the conductive member 22 should be made of nickel or palladium.

Hereinafter, several concrete examples of the coiled component K2 are described.

CONCRETE EXAMPLE 1

8 g of butyral resin, 4 g of butyl benzyl phthalate, 24 g of methyl ethyl ketone and 24 g of butyl acetate are mixed with 100 g of NiZnCu series ferrite powder and are kneaded by using a pot mill so as to obtain ferrite slurry. By using this slurry, a ferrite green sheet having a thickness of 0.2 mm after its drying is produced with a coater. Meanwhile, the green sheet is formed on a PET film. These three ferrite green sheets are laminated on one another. For laminating the ferrite green sheets on one another, a steam platen press is employed by setting temperature of a steam platen at 100° C. and pressure at 500 kg/cm$^2$. By using a die and a puncher, the predetermined hollow 21*a* is formed on the laminated ferrite green sheets as shown in FIG. 19 such that not only the conductive member 22 having a plurality of turns gradually different, in diameter, from each other from one end towards the other end of the conductive member 22 is formed on the peripheral surface of the hollow 21*a* but at least the respective turns of the conductive member 22 are disposed in different planes. As a result, the hollow insulating member, namely, the outer insulating member 21 having the conical hollow 21*a* formed at its central portion is obtained.

Subsequently, as shown in FIG. 20, by using commercially available silver paste and a printing machine, the conductive member 22 having a plurality of turns gradually different, in diameter, from each other from one end towards the other end of the conductive member 22 is formed on the peripheral surface of the hollow 21*a* of the outer insulating member 21 such that at least the respective turns of the conductive member 22 are disposed in different planes. Meanwhile, in printing of the conductive member 22, the outer insulating member 21 is subjected to suction from its face opposite to the printing face in the same manner as well-known through-hole printing such that the silver paste remains at corners of the step 21*b* on the peripheral surface of the hollow 21*a*.

Then, as shown in FIG. 21, the lead-out electrode 23 is formed on the previously produced ferrite green sheet of 0.2 mm in thickness by using the same silver paste and printing machine as described above. Namely, the lead-out electrode 23 is formed on the lower magnetic layer 29. Furthermore, the lower magnetic layer 29 is bonded to the outer insulating member 21 formed with the conductive member 22.

Subsequently, as shown in FIG. 22, the above mentioned ferrite slurry is filled into the hollow 21*a* of the outer insulating member 21 so as to obtain the substantially flat ferrite green sheets. Namely, by this filling of the ferrite slurry, the inner insulating member 27 is formed.

Thereafter, as shown in FIG. 23, the lead-out electrode 24 is likewise formed on the previously produced ferrite green sheet of 0.2 mm in thickness. Namely, the lead-out electrode 24 is formed on the upper magnetic layer 28. The upper magnetic layer 28, the outer insulating member 21 formed with the conductive member 22, the inner insulating member 27 and the lower magnetic layer 29 are laminated on one another as shown in FIG. 23 by using a laminating press. In addition, as shown in FIG. 24, the end face electrodes 25 and 26 are formed by using commercially available silver paste and the laminate is subjected to firing at 900° C. for two hours.

No defects such as peeling, cracks, warpage, etc. were found in the coiled component of the concrete example 1 produced by the above mentioned production method. Through measurements of its various electrical characteristics by using an impedance analyzer, etc., it was found that the coiled component of the concrete example 1 has excellent electrical characteristics. Therefore, in the coiled component of the concrete example 1 having the number of lamination less than those of known lamination type coiled components, more excellent electrical characteristics than those of the known lamination type coiled components can be obtained.

CONCRETE EXAMPLE 2

In the same manner as the concrete example 1, 6 g of butyral resin, 4 g of butyl benzyl phthalate and butyl acetate are mixed with 100 g of NiZnCu series ferrite powder and are kneaded by using kneaded by using a pot mill so as to obtain ferrite slurry. By using this slurry in the same manner as the concrete example 1, a ferrite green sheet having a thickness of 0.6 mm after its drying is produced with a coater on a sheetlike polyimide member having the shape for forming the predetermined hollow 21*a* in which the conductive member 22 having a plurality of turns gradually different, in diameter, from each other from one end to the other end of the conductive member 22 are formed such that at least the respective turns of the conductive member 22 are disposed in different planes. As a result, the outer insulating member 21 is obtained.

Subsequently, in the same manner as the concrete example 1, the conductive member 22 is formed on the peripheral surface of the hollow 21*a* of the outer insulating member 21. Furthermore, as shown in FIGS. 19 to 24, the upper and lower magnetic layers 28 and 29, the inner insulating member 27 and the end face electrodes 25 and 26 are formed in the same manner as the concrete example 1 and the laminate is subjected to firing at 900° C. for two hours.

No defects such as peeling, cracks and warpage were found in the coiled component of the concrete example 2 produced by the above mentioned production method. Through measurements of its various electrical characteristics by using an impedance analyzer, etc., it was found that the coiled component of the concrete example 2 has excellent electrical characteristics. Therefore, in the coiled component of the concrete example 2 having the number of lamination less than those of prior art lamination type coiled components, more excellent electrical characteristics than those of the prior art lamination type coiled components can be obtained.

Furthermore, in the production method of the concrete example 2, the outer insulating member 21 can be formed by a single operational step smaller, in number, than that of the concrete example 1, thereby resulting in reduction of the number of operational steps advantageously.

Figure 25:
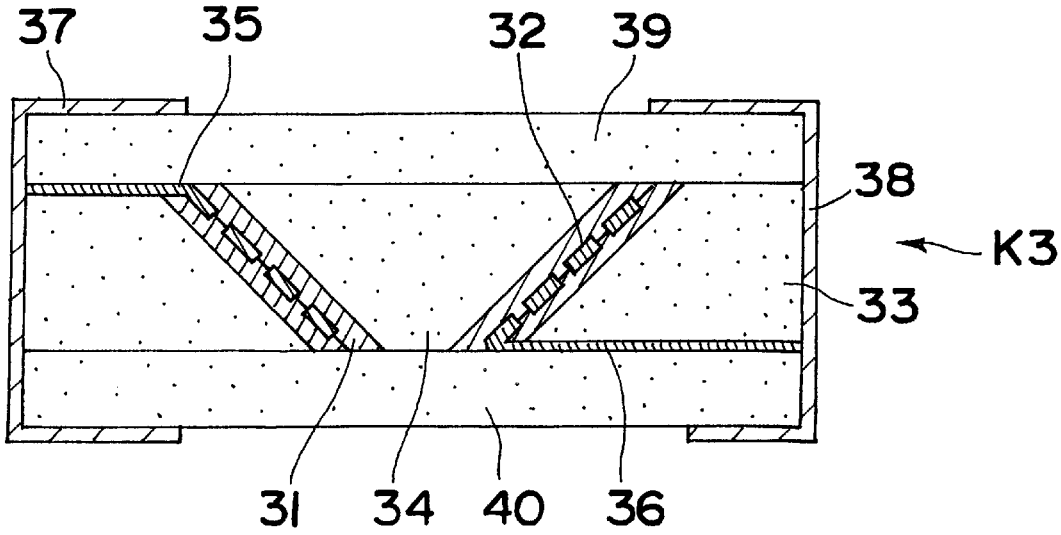
FIG. 25 is a sectional view of a coiled component according to a third embodiment of the present invention.

FIG. 25 shows a coiled component K3 according to a third embodiment of the present invention. In the coiled component K3, a conductive member 32 having a plurality of turns gradually different, in diameter, from each other from one end towards the other end of the conductive member 32 is provided in a magnetic member 31 such that at least the respective turns of the conductive member 32 are disposed in different planes. The magnetic member 31 is supported by an outer support 33 disposed outside the magnetic member 31 and an inner support 34 disposed inside the magnetic member 31. Opposite ends of the conductive member 32 are connected to lead-out electrodes 35 and 36, respectively. The lead-out electrodes 35 and 36 are, respectively, connected to end face electrodes 37 and 38 which are provided on end faces of upper and lower layers 39 and 40 and the outer support 33. Each of the magnetic member 31, the outer and inner supports 33 and 34 and the upper and lower layers 39 and 40 is made of a single material. The outer and inner supports 33 and 34 and the upper and lower layers 39 and 40 may be made of non-magnetic material or magnetic material. Any electrical insulating material including organic insulating material such as glass epoxy, polyimide, etc. and inorganic insulating material such as glass, glass ceramics and ceramics may be employed as the non-magnetic material. Well-known NiZn series or NiZnCu series ferrite material having large permeability may be employed as the magnetic material.

The conductive member 32 and the lead-out electrodes 35 and 36 may be made of any electrically good conductor. However, since resistivity is vital in the coiled component and the coiled component has low electric resistance, conductors such as copper, silver and alloy of silver and palladium can be effectively employed.

The end face electrodes 37 and 38 may be made of any electrically conductive material but generally are each formed by not a single layer but a plurality of layers desirably. In case the end face electrodes 37 and 38 are of surface mounting type, mounting strength of the end face electrodes 37 and 38 or wetting of solder and solder penetration on the end face electrodes 38 and 38 at the time of mounting of their mounting on a printed-wiring board should be taken into consideration. More specifically, the same conductive materials as that of the lead-out electrodes 35 and 36 is employed for the lowermost layer, nickel resistant to solder is employed for an intermediate layer and solder or tin having excellent wetting against solder is employed for the outermost layer. However, this arrangement is merely one example and thus, is not necessarily required to be employed. Therefore, material having excellent electrical conductivity, for example, metal may be replaced by electrically conductive resinous material.

Meanwhile, in case after a predetermined wiring pattern has been formed on a substrate of ceramics such as alumina or ferrite and the coiled component has been inserted into a window formed on the ceramic substrate, the wiring pattern and the end face electrodes 37 and 38 are brought into contact with each other and are subjected to wiring by utilizing a thick film forming process so as to be electrically connected to each other, heat resistance of the end face electrodes 37 and 38 may be raised such that the end face electrodes 37 and 38 have an arrangement suitable for this thick film forming process.

The conductive member 32 may have a sectional shape other than a flat rectangle so as to have large sectional area leading to low electric resistance such that large electric current can be applied to the coiled component. In this case, the sectional shape of the conductive member 32 other than the flat rectangle includes a triangle, a circle, an ellipse, a semicircle, a polygon, etc. In order to obtain the conductive member 32 having such a sectional shape as described above, a step is formed on a peripheral surface of a hollow of the outer support 33 and electrically conductive paste is applied to the step of the outer support 33 so as to be dried. Then, magnetic paste is further applied to the step of the outer support 33 so as to be dried and thus, the conductive member 32 having the triangular sectional shape can be obtained.

Meanwhile, in the above mentioned example, the conductive member 32 as a whole has a circular shape but may also have a polygonal shape. Namely, conventionally, prismatic shape is preferably employed for a surface mounting type coiled component. The prismatic coiled component has polygonal turns such that the polygonal turns extend substantially to external shape of the coiled component. In order to obtain the coiled component referred to above, a pyramidal hollow, for example, is formed on the outer support 33 and then, the magnetic member 31 and the conductive member 32 are formed on a peripheral surface of the pyramidal hollow. Subsequently, by filling the pyramidal hollow with the inner support 34, polygonal turns can be formed in the magnetic member 31.

As described above in the several examples of the coiled component K3, the conductive member 32 is continuously formed so as to have a plurality of the turns gradually different, in diameter, from each other from one end towards the other end of the conductive member 32 such that at least the respective turns of the conductive member 32 are disposed in the different planes. Therefore, in contrast with the conventional laminated structure, the coiled component K3 can be produced easily and yield of the coiled component K3 can be raised. Furthermore, since adjacent ones of the turns of the conductive member 32 do not confront each other facially through the magnetic member 31, production of stray capacity is minimized and thus, its self resonant frequency is reduced. Therefore, if the coiled component K3 is employed as a filter or the like, large attenuation is performed in a broad band. Accordingly, the coiled component K3 is remarkably excellent in quality and performance.

Meanwhile, in the above third embodiment, the coiled component is of facial mounting type in which the end face electrodes 37 and 38 are provided on the opposite end faces of the coiled component. However, the coiled component may also have an arrangement in which terminal pins are provided on the outer support 33 or a lead type arrangement in which capped electrodes having terminals in place of the end face electrodes are fitted around opposite ends of the coiled component.

Hereinafter, a production method of the coiled component K3 of the present invention is described. The production method of the coiled component K3 comprises one or both of steps of forming the hollow outer support 33 formed, at its central portion, with a conical or pyramidal hollow and forming the conical or pyramidal inner support 34, a step of forming the magnetic member 31 on one of the peripheral surface of the hollow of the outer support 33 and the peripheral surface of the inner support 34, a step of forming on the magnetic member 31 the conductive member 32 having a plurality of the turns gradually different, in diameter, from each other from the one end towards the other end of the conductive member such that at least the respective turns of the conductive member are disposed in the different planes and a step of forming the magnetic member 31 on the conductive member 32. By this production method, the coiled component K3 is obtained in which the magnetic member 31 is provided on the surface of the outer support 33 or the inner support 34 and the conductive member 32 is provided in the magnetic member 31.

Another production method of the coiled component K3 comprises a step of forming the outer support 33 as in the above production method, a step of forming the inner support 34, a step of forming the magnetic member 31 on one of the peripheral surface of the hollow of the outer support 33 and the peripheral surface of the inner support 34, a step of forming the conductive member 32 on the magnetic member 31 as in the above production method, a step of forming the magnetic member 31 on the conductive member 32 and a step of fitting the inner support 34 into the outer support 33. As a result, the coiled component K3 including the conductive member 32 as in the above production method is obtained. In this case, both the outer support 33 and the inner support 34 surround the magnetic member 31.

Furthermore, in order to obtain the coiled component K3 having the arrangement shown in FIG. 25, the upper and lower layers 39 and 40 are formed on the upper and lower faces of the outer and inner supports 33 and 34 and then, the lead-out electrodes 35 and 36 and the end face electrodes 37 and 38 are formed. These members are not necessarily required to be formed. However, by forming the upper and lower layers 39 and 40, strength and surface property of the coiled component can be improved. Meanwhile, by forming the end face electrodes 37 and 38, the coiled component K3 can be of surface mounting type.

As described above, the coiled component K3 may have different arrangements based on presence or absence of the outer support 33 or the inner support 34 and the upper and lower layers 39 and 40. However, in the fundamental arrangement of the coiled component K3, the conductive member 32 having a plurality of the turns gradually different, in diameter, from each other form the one end towards the other end of the conductive member 32 is formed in the magnetic member 31 such that at least the respective turns of the conductive member 32 are disposed in the different planes. Namely, since the conductive member 32 is formed in the magnetic member 31 having the oblique or steplike thickness, the coiled component K3 can be obtained at high productivity.

Figure 26:
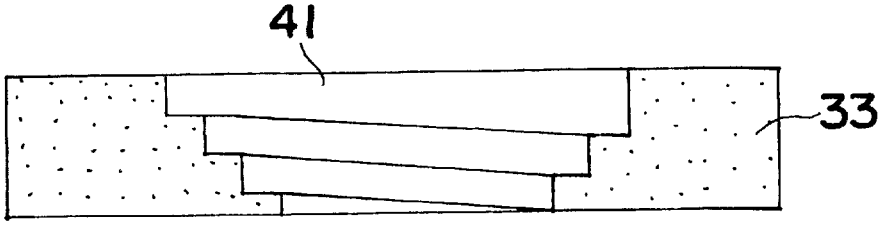
FIGS. 26 to 33 are schematic sectional views showing operational steps in a production method of the coiled component of FIG. 25.

Hereinafter, a production method of the coiled component K3 is described in more detail with reference to FIGS. 26 to 33. Initially, as shown in FIG. 26, the hollow outer support 33 having a conical or pyramidal hollow 41 is formed such that a three-dimensional spiral step is formed on a peripheral surface of the hollow 41 but the conductive member 32 is formed on the step. The conductive member 32 has a plurality of the turns gradually different, in diameter, from each other from the one end towards the other end of the conductive member 32 such that at least the respective turns of the conductive member 32 are disposed in the different planes.

The hollow 41 may have simple conical shape or pyramidal shape on the condition that the conductive member 32 having a plurality of the turns gradually different, in diameter, from each other from the one end towards the other end of the conductive member 32 is formed on the peripheral surface of the hollow 41 such that at least the respective turns of the conductive member 32 are disposed in the different planes. On the other hand, in case the hollow 41 has steplike surface in place of simple oblique surface and the conductive member 32 is formed at corners of the steplike surface, the conductive member as a whole should have a plurality of the turns gradually different, in diameter, from each other from the one end towards the other end of the conductive member 32 such that at least the respective turns of the conductive member 32 are disposed in the different planes.

In order to form the outer support 33 formed with the hollow 41 having the peripheral surface of the above described shape, a method may be employed in which slurry of insulating material, for example, is poured onto a base having a projection engageable with the hollow 41. After the slurry has been dried to an insulating member, the insulating member is separated from the base and thus, the specific hollow 41 can be formed on the insulating member. Meanwhile, in another method, after slurry of insulating material has been poured onto a flat base so as to obtain a flat sheetlike insulating member, the specific hollow 41 is formed on the insulating member by using a die having a shape for forming the hollow 41. Furthermore, alternatively, the hollow outer support 33 having the specific hollow 41 can be likewise formed by well-known powder molding method. In any one of these methods, the hollow outer support 33 having the specific hollow 41 can be formed. In addition, as described above, the peripheral surface of the hollow 41 may be oblique or steplike as described above.

Figure 27:
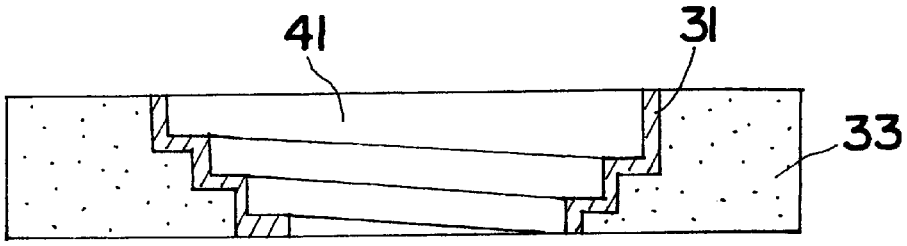
Figure 28:
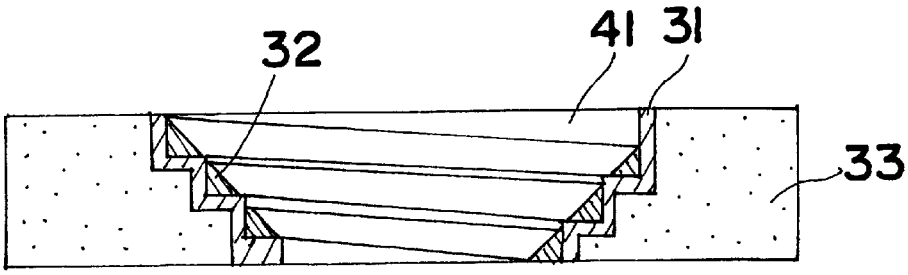
Figure 29:
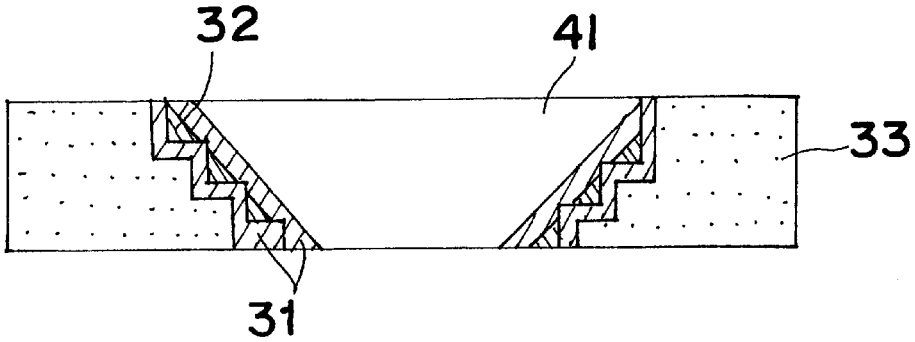

Then, as shown in FIG. 27, the magnetic member 31 is formed on the spiral step of the hollow 41 of the outer support 33. Subsequently, as shown in FIG. 28, the conductive member 32 is formed on the magnetic member 31. The conductive member 32. has a plurality of the turns gradually different, in diameter, from each other from the one end towards the other end of the conductive member 32 such that at least the respective turns of the conductive member 32 are disposed in the different planes. As described above, the conductive member 32 may be of spiral shape obtained by lifting a central portion of a coil fanwise or a shape having a series of concentric circles. Thereafter, as shown in FIG. 29, the magnetic member 31 is formed so as to cover the conductive member 32. By the above described operational steps, the conductive member 32 is located in the magnetic member 31 and has a plurality of the turns gradually different, in diameter, from each other from the one end towards the other end of the conductive member 32 such that at least the respective turns of the conductive member 32 are disposed in the different planes.

Figure 30:
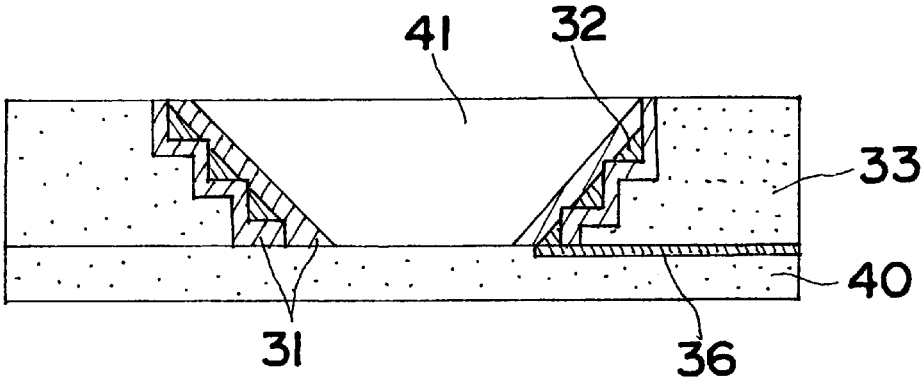

Then, as shown in FIG. 30, the lower layer 40 on which the lead-out electrode 36 leading to a small-diameter end portion of the conductive member 32 has been formed preliminarily is joined to a lower face of the outer support 33.

Figure 31:
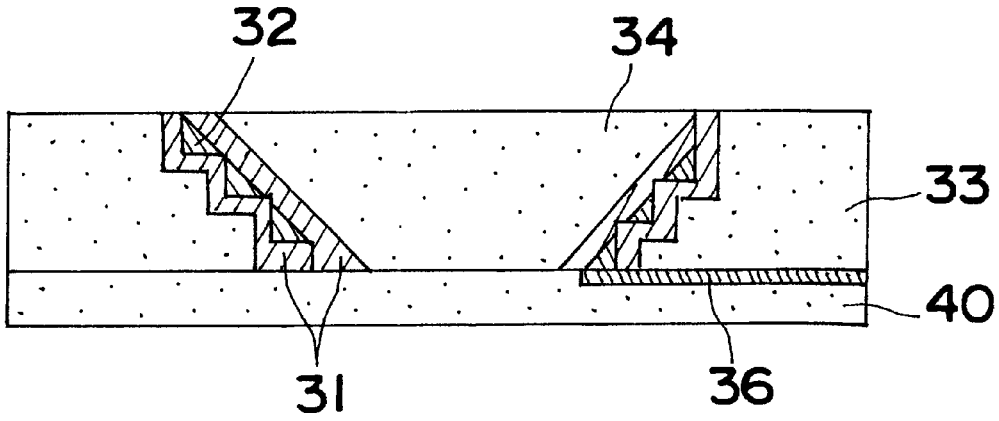

Subsequently, as shown in FIG. 31, insulating material is filled into the hollow 41 defined by the outer support 33 and the lower layer 40 so as to form the inner support 34.

Figure 32:
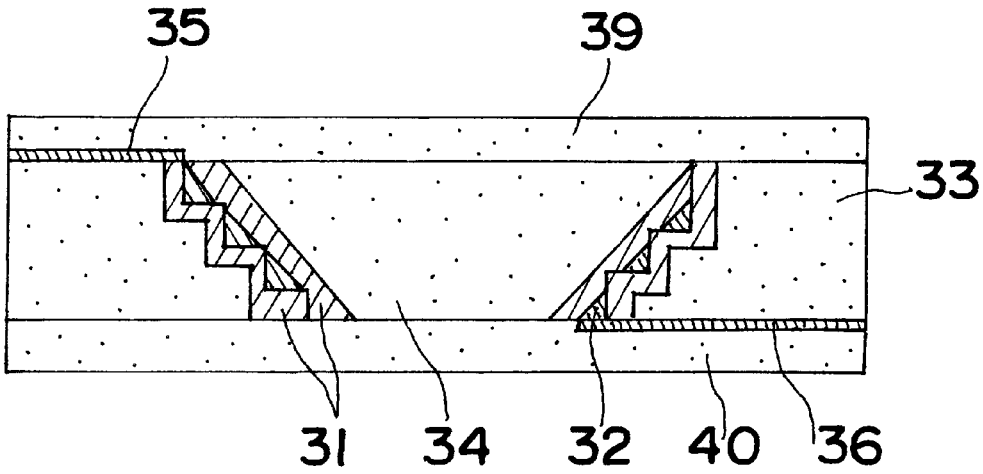

Thereafter, as shown in FIG. 32, in the same manner as formation of the lower layer 40, the upper layer 39 on which the lead-out electrode 39 leading to a large-diameter end portion of the conductive member 32 has been formed preliminarily is joined to an upper face of the outer support 33.

Figure 33:
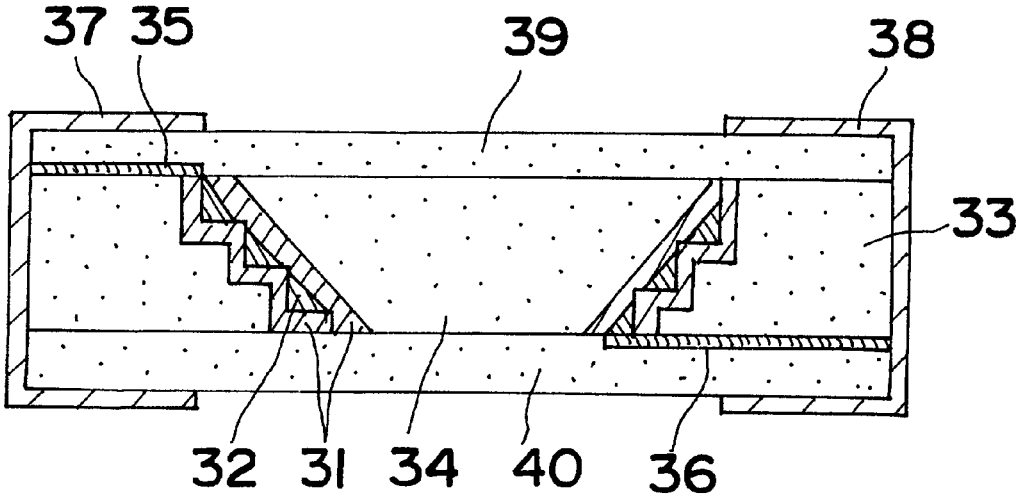

Furthermore, as shown in FIG. 33, the end face electrodes 37 and 38 are, respectively, formed on opposite end faces of the chip member of FIG. 32. By subjecting the thus obtained laminate to firing, the coiled component K3 can be obtained. However, firing may also be performed without forming the end face electrodes 37 and 38. Namely, the laminate which does not have the end face electrodes 37 and 38 is subjected to firing and then, the end face electrodes 37 and 38 are formed on the laminate. In one example of formation of the end face electrodes 37 and 38 at this time, conductive layers are formed on the laminate so as to have shape similar to that of the end face electrodes 37 and 38 and are subjected to firing once. Subsequently, by using the conductive layers as electrodes, the laminate is subjected to nickel plating and soldering or tin plating. Finally, each of the end face electrodes 37 and 38 has a three-layer construction of the substrate conductive layer formed by firing, nickel of electroplating and solder or tin of electroplating.

The above outer and inner supports 33 and 34 or the upper and lower layers 39 and 40 can be formed by well-known green sheet molding method, printing method, dipping method, powder molding method or spin coating method. Printing method is generally employed for forming the conductive member 32 and the lead-out electrodes 35 and 36 but may be replaced by patterning method using a laser, a method in which a conductor formed preliminarily to a predetermined shape by a die or the like is transferred, dripping method, potting method or spray coating method.

The coiled component K3 obtained by the above mentioned production method has excellent heat resistance and therefore, can be made modular easily. For example, a predetermined wiring layer is formed on a substrate of ceramics such as alumina and ferrite and the substrate and the coiled component K3 can be made integral or assembled with each other by simultaneously connecting a circuit of the substrate and the end face electrode 37 or 38 to each other. In this case, since the end face electrode 37 or 38 of the coiled component K3 can be connected to the circuit of the substrate by forming a window at a predetermined location of the substrate, a thin module can be obtained. In this case, well-known ordinary thick film forming process utilizing a ceramic substrate can be employed. The end face electrodes 37 and 38 of the coiled component K3 are not necessarily required to be soldered but may also be subjected to firing for electrical connection.

In the coiled component K3, two terminals of the conductive member 32 are electrically connected to the end face electrodes 37 and 38 formed on the opposite end faces of the chip member. Namely, the lead-out electrodes 35 and 36 for electrically connecting the conductive member 32 to the end face electrodes 37 and 38 are provided at an uppermost portion and a lowermost portion of the conductive member 32 so as to be connected to the end face electrodes 37 and 38.

In paste for forming each layer of the coiled component K3, solvent such as butyl Carbitol, terpineol and alcohol, binder such as ethyl cellulose, polyvinyl butyral, polyvinyl alcohol, polyethylen oxide and ethylene-vinyl acetate, firing auxiliary such as various oxides and glass, plasticizer such as butyl benzyl phthalate, dibutyl phthalate and glycerin or dispersant may be added to each powder. Each layer of the coiled component K3 is formed by using a kneaded article in which these substances are mixed with each other. These layers are laminated on one another to the above mentioned predetermined structure and are subjected to firing, so that the coiled component K3 is obtained. In case a green sheet is produced, it is desirable to replace the above mentioned solvent by various solvents having excellent evaporation property, for example butyl acetate, methyl ethyl ketone, toluene and alcohol.

Firing temperature ranges from about 800 to 1300° C. and changes especially in accordance with material of the conductive member 32. For example, in case the conductive member 32 is made of silver, firing temperature should be set at 900° C. approximately. Meanwhile, in case the conductive member 32 is made of alloy of silver and palladium, firing temperature should be set at 950° C. In order to set firing temperature higher, the conductive member 32 should be made of nickel or palladium.

Hereinbelow, concrete examples of the coiled component K3 are described.

CONCRETE EXAMPLE 1

8 g of butyral resin, 4 g of butyl benzyl phthalate, 24 g of methyl ethyl ketone and 24 g of butyl acetate are mixed with 100 g of composite glass powder obtained by mixing alumina powder and crystallizing glass powder with each other and are kneaded by using a pot mill so as to obtain insulating slurry.

Then, 2 g of ethyl cellulose and 20 g of α-terpineol are mixed with 100 g of NiZnCu series ferrite powder and are kneaded by using three rolls so as to obtain ferrite paste.

By using this insulating slurry, an insulating green sheet having a thickness of 0.2 mm after its drying is produced with a coater. Meanwhile, the insulating green sheet is formed on a PET film. These three insulating green sheets are laminated on one another. For laminating the insulating green sheets on one another, a steam platen press is employed by setting temperature of a steam platen at 100° C. and pressure at 500 kg/cm$^2$. By using a die and a puncher, the predetermined hollow 41 is formed on the laminated insulating green sheets as shown in FIG. 26 such that not only the conductive member 32 having a plurality of the turns gradually different, in diameter, from each other from the one end towards the other end of the conductive member 32 is formed on the peripheral surface of the hollow 41 but at least the respective turns of the conductive member 32 are disposed in the different planes. As a result, the hollow outer support 33 having the conical hollow 41 formed at its central portion is formed.

Subsequently, as shown in FIG. 27, the magnetic member 31 is formed on the peripheral surface of the hollow 41 of the outer support 33 by using the ferrite paste and a printing machine. Then, as shown in FIG. 28, the conductive member 32 is formed on the magnetic member 31. Thereafter, as shown in FIG. 29, the magnetic member 31 is formed on the conductive member 32. Meanwhile, commercially available silver paste is printed for forming the conductive member 32. The conductive member 32 has a plurality of the turns gradually different, in diameter, from each other from the one end towards the other end of the conductive member such that at least the respective turns of the conductive member 32 are disposed in the different planes. Meanwhile, in printing of the magnetic member 31 and the conductive member 32, the outer support 33 is subjected to suction from its face opposite to the printing face in the same manner as well-known through-hole printing such that the ferrite paste and the silver paste remain on the steplike peripheral surface of the hollow 41.

Thereafter, as shown in FIG. 30, the lead-out electrode 36 is formed on the previously produced insulating green sheet having a thickness of 0.2 mm by using the same silver paste and printing machine as described above so as to produce the lower layer 40. Furthermore, the lower layer 40 is bonded to the outer support 33 formed with the conductive member 32.

Furthermore, as shown in FIG. 31, the insulating slurry referred to above is poured into the hollow 41 so as to be substantially flush with the outer support 33. Namely, by this filling of the insulating slurry, the inner support 34 is formed.

Then, as shown in FIG. 32, by using the same silver paste and printing machine as described above, the lead-out electrode 35 is formed on the previously produced insulating green sheet of 0.2 mm in thickness so as to obtain the upper layer 39. In addition, the upper layer 39 is bonded to the outer and inner supports 33 and 34 in which the magnetic member 31 and the conductive member 32 are formed.

Moreover, as shown in FIG. 33, the end face electrodes 37 and 38 are formed by using commercially available silver paste and are subjected to firing at 900° C. for two hours.

No defects such as peeling, cracks, warpage, etc. were found in the coiled component of the concrete example 1 produced by the above mentioned production method. Through measurements of its various electrical characteristics by using an impedance analyzer, etc., it was found that the coiled component of the concrete example 1 has excellent electrical characteristics. Therefore, in the coiled component of the concrete example 1 having the number of lamination less than those of known lamination type coiled components, more excellent electrical characteristics than those of the known lamination type coiled components can be obtained.

CONCRETE EXAMPLE 2

By using the same insulating slurry as the concrete example 1, an insulating green sheet having a thickness of 0.6 mm after its drying is formed with a coater on a sheetlike polyimide member having the shape for forming the predetermined hollow 41 in which the conductive member 32 having a plurality of turns gradually different, in diameter, from each other from one end towards the other end of the conductive member 32 are formed such that at least the respective turns of the conductive member 32 are disposed in different planes. As a result, the outer support 33 is obtained.

Then, in the same manner as the concrete example 1, the magnetic member 31 and the conductive member 32 are formed on the peripheral surface of the hollow 41. Furthermore, in the same manner as the concrete example 1, the upper and lower layers 39 and 40, the inner support 34, the lead-out electrodes 35 and 36 and the end face electrodes 37 and 38 are formed and the laminate is subjected to firing at 900° C. for two hours.

No defects such as peeling, cracks and warpage were found in the coiled component of the concrete example 2 produced by the above mentioned method. Through measurements of its various electrical characteristics by using an impedance analyzer, etc., it was found that the coiled component of the concrete example 2 has excellent electrical characteristics. Furthermore, in the production method of the concrete example 2, the outer support 33 can be formed by a single operational step smaller, in number, than that of the concrete example 1, thereby resulting in reduction of the number of operational steps advantageously.

CONCRETE EXAMPLE 3

The hollow outer support 33 produced in the concrete example 2 is subjected to firing at 850° C. for 10 min. Subsequently, in the same manner as the concrete example 1, the magnetic member 31, the conductive member 32 and the inner support 34 are formed in the hollow 41 subjected to firing. Furthermore, in the same manner as the concrete example 1, the upper and lower layers 39 and 40, the lead-out electrodes 35 and 36 and the end face electrodes 37 and 38 are formed and the laminate is subjected to firing at 900° C. for two hours.

No defects such as peeling, cracks and warpage were found in the coiled component of the concrete example 3 produced by the above mentioned production method. Through measurements of its various electrical characteristics by using an impedance analyzer, etc., it was found that the coiled component of the concrete example 3 has excellent electrical characteristics.

Figure 34:
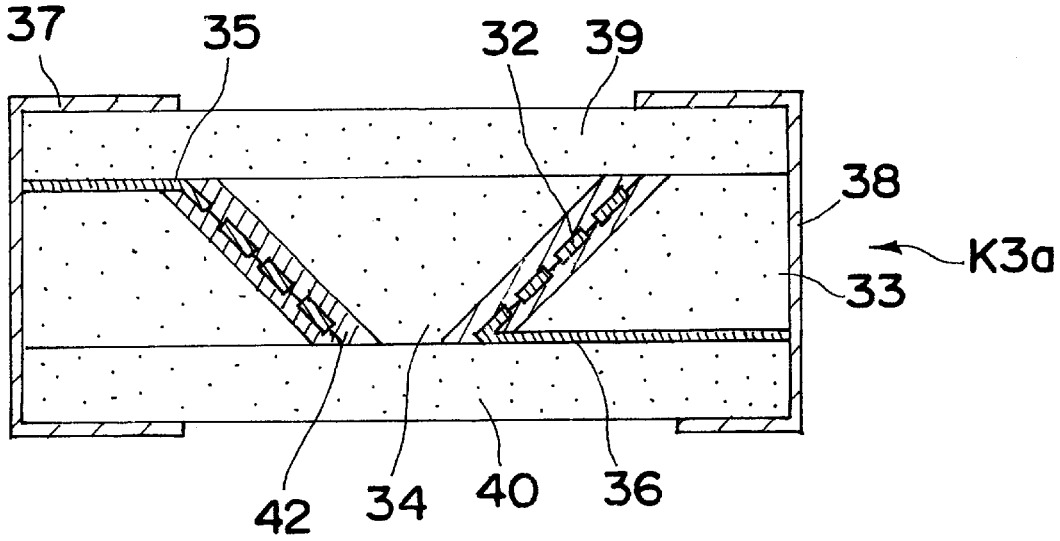
FIG. 34 is a view similar to FIG. 25, particularly showing its modification.
Figure 35:
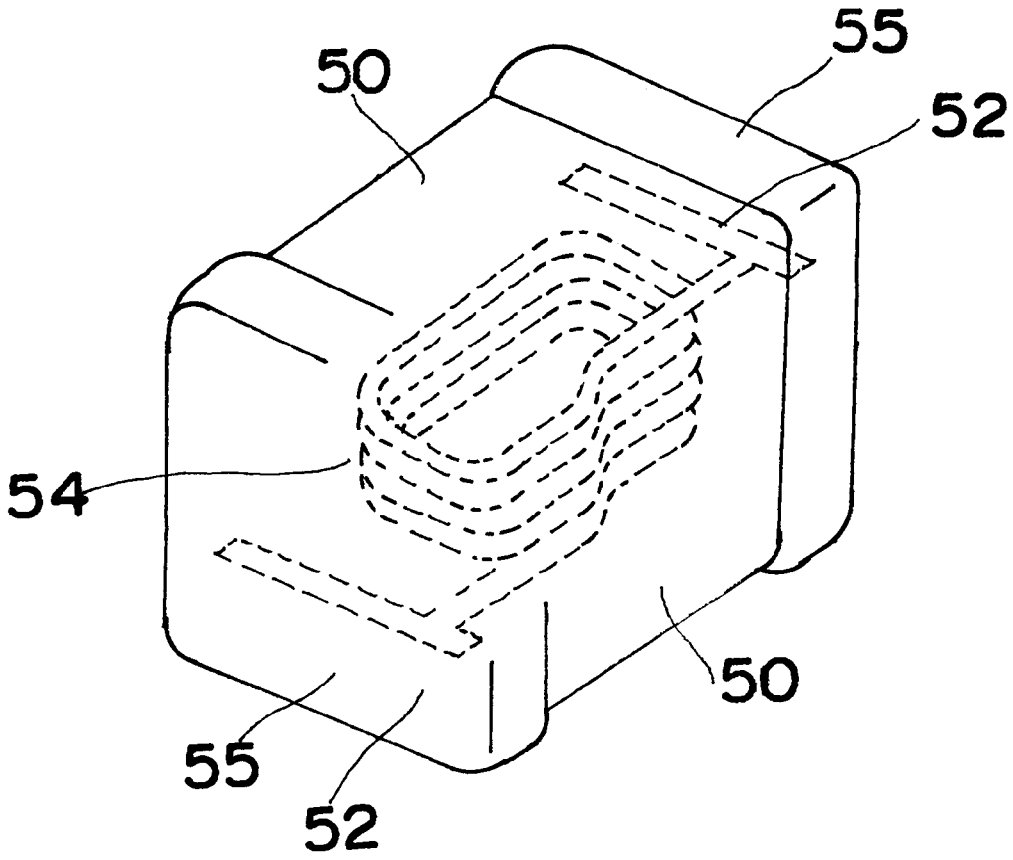
Fig. 35 (PRIOR ART)
FIG. 35 is a schematic perspective view of a prior art coiled component.
Figure 36:
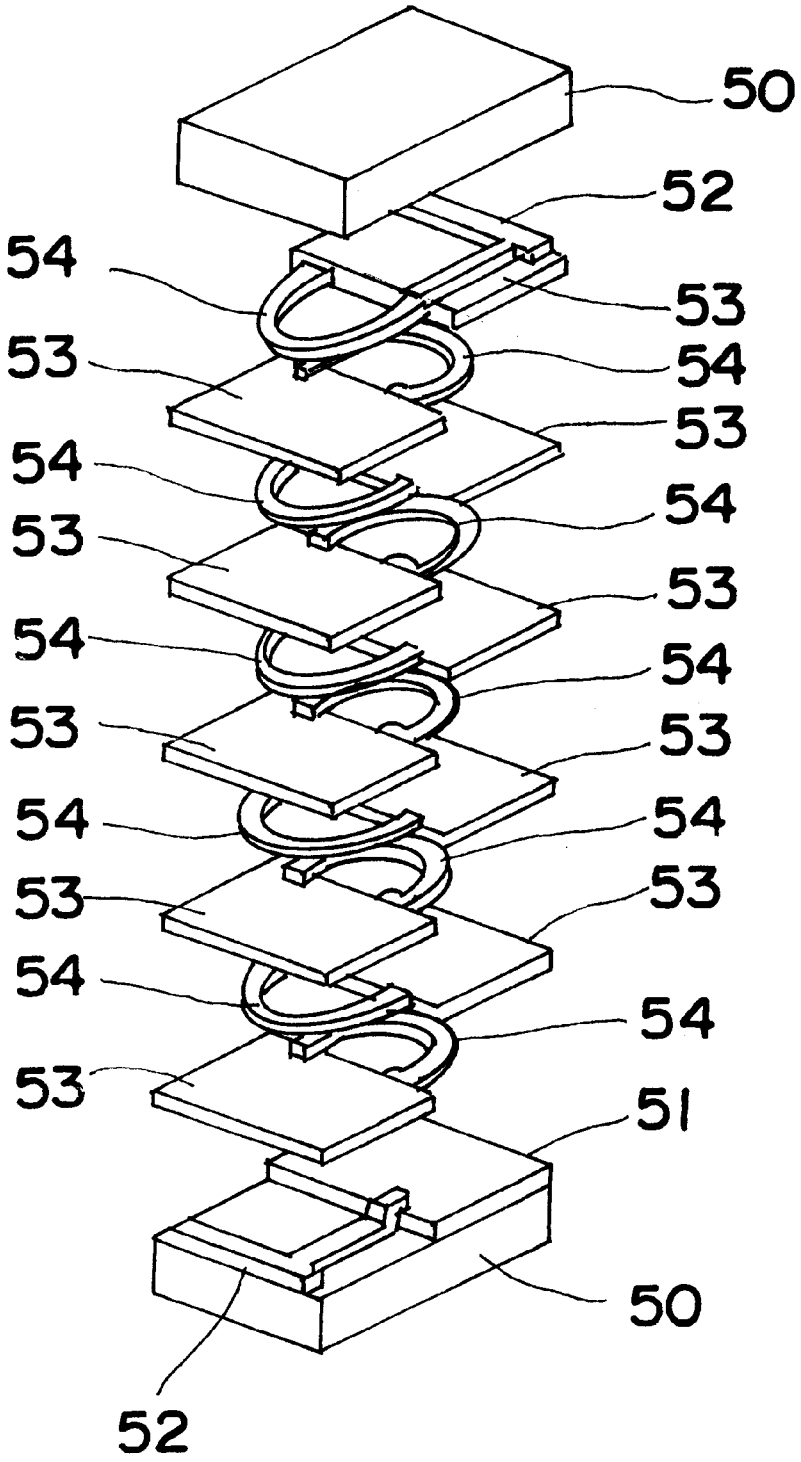
Fig. 36 (PRIOR ART)
FIG. 36 is an exploded perspective view of the prior art coiled component of FIG. 35.

FIG. 34 shows a coiled component K3*a* which is a modification of the coiled component K3. In the coiled component K3*a*, the conductive member 32 having a plurality of the turns gradually different, in diameter, from each other from the one end towards the other end of the conductive member 32 is provided in a non-magnetic member 42 such that at least the respective turns of the conductive member 32 are disposed in the different planes. The non-magnetic member 42 is supported by the outer support 33 disposed outside the non-magnetic member 42 and the inner support 34 disposed inside the non-magnetic member 42. Opposite ends of the conductive member 32 are connected to the lead-out electrodes 35 and 36, respectively. The lead-out electrodes 35 and 36 are, respectively, connected to the end face electrodes 37 and 38 which are provided on the end faces of the upper and lower layers 39 and 40 and the outer support 33. Each of the non-magnetic member 42, the outer and inner supports 33 and 34 and the upper and lower layers 39 and 40 is made of a single material. The outer and inner supports 33 and 34 and the upper and lower layers 39 and 40 may be made of magnetic material or non-magnetic material.

The coiled component K3*a* is structurally different from the coiled component K3 only in that the magnetic material 31 provided between the outer and inner supports 33 and 34 in the coiled component K3 is replaced by the non-magnetic material 42 in the coiled component K3*a*. Since other constructions of the coiled component K3*a* are the same as those of the coiled component K3, description of a production method of the coiled component K3*a* is abbreviated for the sake of brevity.

By this structural difference between the coiled components K3*a* and K3, in case the non-magnetic member 42 is provided between the outer and inner supports 33 and 34 and the outer and inner supports 33 and 34 are made of magnetic material in the coiled component K3*a*, flow of magnetic flux can be controlled. On the other hand, in case the magnetic member 31 is provided between the outer and inner supports 33 and 34 as in the coiled component K3, the outer and inner supports 33 and 34 merely function as structural elements for supporting the conductive member 32, so that material in which priority is given to mechanical properties can be selected for the outer and inner supports 33 and 34.

As described above, the production method of the coiled component K3*a* is similar to that of the coiled component K3. However, in accordance with whether the member surrounding the conductive member 32 is formed by the magnetic member 31 or the non-magnetic member 42, electrical characteristics obtained in the coiled components K3 and K3*a* can be properly changed to desirable ones.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

INDUSTRIAL APPLICABILITY

As is clear from the foregoing description, the production method of the coiled component of the present invention is not of lamination type and therefore, provides high productivity. Meanwhile, since the conductive member is provided on the oblique peripheral surface or the stepwise oblique peripheral surface of, for example, the conical or pyramidal hollow formed at the central portion of the outer insulating member, height of the obtained coiled component can be lessened. Furthermore, since stray capacity between neighboring ones of the turns of the conductive member is not produced substantially, the coiled component has excellent electrical characteristics, thereby resulting in great industrial applicability.

What is claimed is:

1. A chip-type coiled component comprising:

an insulating member having an upper face and a lower face;

a magnetic layer provided on at least one of the upper and lower faces of said insulating member; and a conductive member provided in said insulating member and having a plurality of turns forming a three-dimensional spiral shape extending from one end of said conductive member towards the other end of said conductive member, wherein the turns of said conductive member are gradually different, in diameter, from each other from one end of said conductive member towards the other end of said conductive member such that at least the turns of said conductive member are each disposed in different planes.

2. The chip-type coiled component as claimed in claim 1, wherein said magnetic layer is formed of electrical insulating material.

3. The chip-type coiled component as claimed in claim 1, wherein said magnetic layer is formed of electrically conductive material.

4. The chip-type coiled component as claimed in claim 1, wherein each of the turns of said conductive member is disposed in an identical plane from the one end towards the other end of said conductive member and a terminal end and an initial end of each of the turns of said conductive member are connected to adjoining upper and lower ones of the turns of said conductive member.

5. The chip-type coiled component as claimed in claim 1, wherein each of the turns of said conductive member has a circular shape.

6. The chip-type coiled component as claimed in claim 1, wherein each of the turns of said conductive member has a polygonal shape.

7. The chip-type coiled component as claimed in claim 1, wherein said conductive member defines a largest diameter end, and is formed such that a gap between neighboring ones of the turns of said conductive member is not visible when said conductive member is observed from the largest diameter end of said conductive member.

8. The chip-type coiled component as claimed in claim 1, wherein said conductive member has an angular sectional shape.

9. The chip-type coiled component as claimed in claim 1, wherein said conductive member has a circular sectional shape.

10. The chip-type coiled component as claimed in claim 1, wherein said conductive member has a semicircular sectional shape.

11. The chip-type coiled component as claimed in claim 1, wherein said insulating member is formed of non-magnetic material.

12. The chip-type coiled component as claimed in claim 1, wherein said insulating member is formed of magnetic material.

13. The chip-type coiled component as claimed in claim 1, wherein said insulating member includes:

an outer insulating member disposed outside of said conductive member; and an inner insulating member disposed inside of said conductive member such that said conductive member is interposed between said outer insulating member and said inner insulating member, wherein one of said outer and inner insulating members is formed of a non-magnetic material, and the other of said outer and inner insulating members is formed of a magnetic material.

14. The chip-type coiled component as claimed in claim 1, further comprising:

a first electrode provided on a first end face of said insulating member and connected to the one end of said conductive member;

a second electrode provided on a second end face of said insulating member and connected to the other end of said conductive member, wherein said first and second end faces are disposed on opposite sides of said insulating member, respectively.

15. The chip-type coiled component as claimed in claim 14, wherein said first and second electrodes are also disposed on opposite end faces of said magnetic layer, respectively.

16. The chip-type coiled component as claimed in claim 1, wherein the turns of said conductive member are progressively increased in diameter so that adjacent turns do not overlap.

17. A chip-type coiled component comprising:

an insulating member having an upper face and a lower face;

a first magnetic layer provided on the upper face of said insulating member;

a second magnetic layer provided on the lower face of said insulating member; and a conductive member provided in said insulating member and having a plurality of turns forming a three-dimensional spiral shape extending from one end of said conductive member towards the other end of said conductive member, wherein the turns of said conductive member are gradually different, in diameter, from each other from one end of said conductive member towards the other end of said conductive member such that at least the turns of said conductive member are each disposed in different planes.

* * * * *